US011504723B2

(12) United States Patent
Grigor et al.

(10) Patent No.: US 11,504,723 B2
(45) Date of Patent: Nov. 22, 2022

(54) SPRAY HEADS

(71) Applicant: Methven Limited, Auckland (NZ)

(72) Inventors: Andrew John Grigor, Auckland (NZ); Chad Robert Bauer, Havelock North (NZ); Stephen Mclay McCutcheon, Auckland (NZ); Nicholas Michael Lawrence Ashby, Auckland (NZ); Robert Nicholas Edward Bolus, Auckland (NZ); Brett Band, Auckland (NZ)

(73) Assignee: Methven Limited, Auckland (NZ)

( * ) Notice: Subject to any disclaimer, the term of this patent is extended or adjusted under 35 U.S.C. 154(b) by 121 days.

(21) Appl. No.: 16/638,341

(22) PCT Filed: Aug. 13, 2018

(86) PCT No.: PCT/NZ2018/050112
§ 371 (c)(1),
(2) Date: Feb. 11, 2020

(87) PCT Pub. No.: WO2019/031973
PCT Pub. Date: Feb. 14, 2019

(65) Prior Publication Data

US 2020/0222918 A1 Jul. 16, 2020

(30) Foreign Application Priority Data

Aug. 11, 2017 (NZ) ..... 734526

(51) Int. Cl.
*B05B 1/18* (2006.01)
*B05B 1/30* (2006.01)
(Continued)

(52) U.S. Cl.
CPC ..... *B05B 1/185* (2013.01); *B05B 1/3026* (2013.01); *B05B 1/3478* (2013.01); *B05B 1/1654* (2013.01); *B05B 1/1663* (2013.01)

(58) Field of Classification Search
CPC ..... B05B 1/185; B05B 1/3026; B05B 1/3478; B05B 1/1654; B05B 1/1663; B05B 1/3436; B05B 1/3426; B05B 1/18
See application file for complete search history.

(56) References Cited

U.S. PATENT DOCUMENTS 5,172,866 A 12/1992 Ward
7,278,591 B2 * 10/2007 Clearman ..... B05B 3/008 239/380
(Continued)

FOREIGN PATENT DOCUMENTS

CN 203002500 U 6/2013
CN 103405873 A 11/2013
(Continued)

OTHER PUBLICATIONS

Extended European Search Report from European Patent Application No. 18844174.5, dated Apr. 15, 2021 (7 pages).
(Continued)

*Primary Examiner* — Qingzhang Zhou
(74) *Attorney, Agent, or Firm* — Quarles & Brady LLP

(57) ABSTRACT

A spray head adapted for connection to a supply of fluid. The head includes a body to receive the supply of fluid and a number of conical mixing volumes, in fluid connection with the body and supply of fluid, each conical mixing volume having an outlet. Each conical mixing volume includes at least one first inlet for a flow of fluid into the conical mixing volume at an angle to a conical axis thereof, and at least one second inlet for a flow of fluid into the conical mixing volume substantially parallel to the conical axis. There is a valve disposed upstream of the conical mixing volumes, the
(Continued)

valve adapted to divide and vary the supply of fluid flow between the at least one first inlet and the at least one second inlet, which in turn varies the output of the fluid from the outlet of the conical mixing volumes.

22 Claims, 28 Drawing Sheets

(51) Int. Cl.
*B05B 1/34* (2006.01)
*B05B 1/16* (2006.01)

(56) References Cited

U.S. PATENT DOCUMENTS

| | | | |
|---|---|---|---|
| 2013/0221132 | A1 | 8/2013 | Egli |
| 2013/0340162 | A1 | 12/2013 | Peel |
| 2016/0207053 | A1 | 7/2016 | Macsay |

FOREIGN PATENT DOCUMENTS

| | | | |
|---|---|---|---|
| CN | 103962253 | A | 8/2014 |
| JP | 2014133043 | A | 7/2014 |
| WO | 2009/126987 | A1 | 10/2009 |

OTHER PUBLICATIONS

Patent Examination Report 1 from New Zealand Patent Application No. 761643, dated Jun. 25, 2021 (4 pages).
International Search Report from PCT/NZ2018/050112, dated Nov. 6, 2018.
Office Action from Chinese Patent Application No. 201880058290.1, dated Feb. 26, 2021. (33 pages).

* cited by examiner

SPRAY HEADS

This application represents the United States National Stage of International Application No. PCT/NZ2018/050112, filed Aug. 13, 2018, which claims priority to New Zealand Patent Application No. 734526, filed Aug. 11, 2017, which are hereby incorporated by reference in their entirety.

TECHNICAL FIELD OF THE INVENTION

The present invention relates to spray heads for producing a spray of fluid and may have particular application to a shower head.

In particular, though not solely, the present invention is directed to a spray head that has a set of jets from which the output can be continuously varied, for example from a fine mist to a massage or firmer flow.

BACKGROUND OF THE INVENTION

Users of spray heads, for example those in the shower and bath areas, often desire a range of flow forms and types from their spray head for differing functions. For example a user may want a fine delicate spray, almost like a mist for example for relaxing, but may also desire, in the same instance of use, a firmer flow such as straight jets, a massaging flow, a firm spray for rinsing soap and hair products, or a finer spray for general bathing.

Spray heads of the prior art are typically provided with multiple discrete spray functions, each from a plurality of apertures, jets or outlets from which a stream of water issues. A problem with such spray heads of the prior art is that each spray function is notably different, and they often do not provide a continuously adjustable variation of sprays over a spectrum, or the ability to easily vary the spray or jet outlet. They are also bulky due to the number of differing jet types to achieve each of the spray functions, and therefore are also aesthetically unappealing.

The applicant has discovered that many users prefer the ability to easily vary the output from a spray head and thus vary the sensations or functionality from their spray head more than are created by the spray heads of the prior art.

One straight forward way to achieve variability in the spray or outlet is to simply to have a set of jets on the spray head and vary the flow rate to them by increasing or decreasing the amount of water flowing to the spray head. For example, if a lever mixer is used to control temperature by rotation of the lever, and volume flow by pulling the lever in and out, then the increased flow would result in a firmer output from the spray head, while a decreased flow would result in a lighter output. However, this is undesirable as varying the flow rate in this manner may result in too little flow from the spray head resulting in a less than desirable experience for the user.

Another method to achieve different fluid output forms from a spray head is to have several sets of jets each with a distinct flow output and then have a valve that sends the fluid to each set in turn, for example a gentle output set, a more firm 'needle or stream_ like set, and a firmer massage setting. While in practice this works, it has the disadvantage of requiring complex valving and flow paths internally, or leading to the spray head. In addition the spray head must be of sufficient size to accommodate all the differing jets or outlets, even though at any one time only 1 or a mix of sets is being used. An example of such a spray head is that shown in patent publication U.S. Pat. No. 5,172,866 which uses a valving lever mounted on the spray head to change the flow from one jet output set, or set of outputs to another.

In addition such a multi-set output spray head has the disadvantage that it can only output discrete variations in flow, ie one flow type per outlet type. Thus it cannot output a continuum of flows, such as for when a user may want a flow that sits partway between a gentle and firm output.

OBJECT

It is an object of the present invention to provide a spray head and/or a showerhead which will overcome or ameliorate problems with such spray heads/showerheads at present, or which will at least provide a useful choice, or which has one set of nozzles, jets or outlets from which the user can easily and continually adjust the spray type or form that is output.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

BRIEF DESCRIPTION OF THE INVENTION

In a first aspect the present invention may be said to broadly consist in a spray head adapted for connection to a supply of fluid, comprising or including,

- A body to receive the supply of fluid,
- A plurality of conical mixing volumes, in fluid connection with the body and supply of fluid, each conical mixing volume having an outlet, each conical mixing volume including,
  - At least one first inlet for a flow of fluid into the conical mixing volume at an angle to a conical axis thereof, and
  - At least one second inlet for a flow of fluid into the conical mixing volume substantially parallel to the conical axis,
- A valve disposed upstream of the conical mixing volumes, the sliding valve adapted to divide and vary the supply of fluid flow between the at least one first inlet and the at least one second inlet, which in turn varies the output of the fluid from the outlet of the conical mixing volumes.

Preferably the valve is a sliding valve, rotary valve, or similar to divide and vary the supply of fluid.

Preferably the at least one first inlet and the at least one second inlet are formed by an open top at a base of the conical mixing volume.

Preferably the at least one second inlet is upstream of the at least one first inlet.

Preferably the outlet is formed by an aperture at a peak of the conical mixing volume.

Preferably the output of the fluid from the outlet can be varied from, and anywhere in between as a continuum, a fine mist to a hard stream, or needles of water.

Preferably there is a plurality of inlet apertures that form the second inlets.

Preferably there are between 2 and 8 of the inlet apertures.

Preferably there are four inlet apertures.

Preferably there is a plurality of the first inlets.

Preferably there are between 2 and 4 of the first inlets.

Preferably there are two first inlets.

Preferably the plurality of conical mixing volumes is part of a first unitary body, as a conical volume plate.

Preferably each of the conical mixing volumes at least in part defines the at least one first inlet.

Preferably the at least one first inlet is at substantially ninety degrees to the conical axis.

Preferably each of the second inlets is in a second unitary body, as a top plate.

Preferably the top plate seals to the conical volume plate.

Preferably there is a face plate located downstream and sealed to the conical volume plate.

Preferably the face plate has apertures there through for the outlets.

Preferably the sliding valve includes a valve body which slides along a major axis of the body.

Preferably the valve body includes a fluid aperture.

Preferably the sliding valve moves the fluid aperture laterally over a fluid divider.

Preferably the fluid divider divides the supply of fluid as it exits the fluid aperture in to a first supply of fluid and a second supply of fluid.

Preferably the sliding valve is located in the body.

Preferably the first fluid supply is fluidly connected to the first inlet(s).

Preferably the second fluid supply is fluidly connected to the second inlet(s).

Preferably the top plate is sandwiched between the conical mixing plate and a cover plate.

Preferably the top plate and conical volume plate define a first fluid volume that is fed by the first fluid supply and supplies the first inlets.

Preferably the cover plate and top plate define a second fluid volume that is fed by the second fluid supply and supplies the second inlets.

Preferably the cover plate can pass separately the first fluid supply to the first fluid volume, and the second fluid supply to the second fluid volume.

Preferably the conical mixing volumes each have at least one channel on their periphery which at least in part forms the first inlet(s).

Preferably there are two channels on the periphery.

Preferably the at least one inlet is at a tangent to the conical axis.

Preferably the at least one channel is closed or covered by the top plate to form an enclosed at least one first inlet.

Preferably the at least one channel when closed as such forms a jet or pathway for the first supply of fluid into the conical mixing volume.

Preferably the face plate, conical volume plate, top plate and cover plate form a fluidly sealed cassette, with inlets for the first fluid supply and second fluid supply, and the outlets.

Preferably the cassette fluidly connects to the first fluid supply, and second fluid supply from the sliding valve.

Preferably the conical mixing volume is made from a resilient material that can form a seal to the face plate and the top plate.

Preferably at least the top plate forms a sealed conduit for the first fluid supply to the first fluid volume.

Preferably the top plate and the cover plate form the sealed conduit.

Preferably the cover plate part of the sealed conduit seals to the body.

Preferably there is a seal between the body and the cover plate to fluidly seal in the first fluid supply and second fluid supply.

Preferably there is a connection ring that at least covers in part the connection of the cassette to the spray head body.

Preferably the spray head can be mounted on the end of a flexible conduit for the supply of fluid.

Preferably the spray head can be mounted on a rigid conduit for the supply of fluid, for example a shower rail, or through-wall or through ceiling conduit, and maybe rigidly fixed or on an angularly adjustable mount.

In another aspect the present invention may be said to broadly consist in a cassette for a spray head, the cassette fluidly connectable to first fluid supply and a second fluid supply from a spray head body, the spray head body adapted to vary the relative flow rates of the first fluid supply and the second fluid supply, comprising or including, A first fluid volume, located within the cassette, supplied by the first fluid supply, the first fluid volume suppling fluid to a plurality of first inlets, one or more of the plurality of first inlets to each supply one of a plurality of conical mixing volumes at or towards a base thereof, A second fluid volume, located within the cassette, supplied by the second fluid supply, the second fluid volume suppling fluid to a plurality of second inlets, one or more of the plurality of second inlets to each supply one of the plurality of conical mixing volumes at or towards a base thereof, upstream of the first inlets, the second inlets located upstream of the first inlets, wherein the variation in the relative flow rates between the first fluid supply, and the second fluid supply, causes a variation in fluid output from a single outlet of the conical mixing volume at a peak thereof, the outlet being external to the cassette.

In yet another aspect the present invention may be said to broadly consist in a kit of parts for a spray head, comprising or including, A spray head including a head and a body, connectable to a supply of fluid, and within the body there is a valve to output and vary the relative flow rates of a first supply of fluid and a second supply of fluid from the body, A cassette to fluidly connect to the body and first and second supplies of fluid, the cassette, comprising or including, A first fluid volume, located within the cassette, supplied by the first fluid supply, the first fluid volume suppling fluid to a plurality of first inlets, one or more of the plurality of first inlets to each supply one of a plurality of conical mixing volumes at or towards a base thereof, A second fluid volume, located within the cassette, supplied by the second fluid supply, the second fluid volume suppling fluid to a plurality of second inlets, one or more of the plurality of second inlets to each supply one of the plurality of conical mixing volumes at or towards a base thereof, upstream of the first inlets, the second inlets located upstream of the first inlets, wherein the variation in the relative flow rates between the first fluid supply, and the second fluid supply, causes a variation in fluid output from a single outlet of the conical mixing volume at a peak thereof, the outlet being external to the cassette.

Preferably the valve is a sliding valve, rotary valve, or similar to divide and vary the supply of fluid.

Preferably the kit includes mountings or fixings for the spray head to a flexible or rigid conduit for the supply of fluid.

In another aspect the present invention may be said to broadly consist in a spray head as described herein with reference to any one or more of the accompanying drawings.

In another aspect the present invention may be said to broadly consist in a cassette for a spray head as described herein with reference to any one or more of the accompanying drawings.

In another aspect the present invention may be said to broadly consist in shower with a spray head as described herein with reference to any one or more of the accompanying drawings.

In another aspect the present invention may be said to broadly consist in kit of parts as described herein with reference to any one or more of the accompanying drawings.

As used herein the term 'and/or_ means 'and_ or 'or_, or both.

As used herein '(s)_ following a noun means the plural and/or singular forms of the noun.

The term 'comprising_ as used in this specification means 'consisting at least in part of_, When interpreting statements in this specification which include that term, the features, prefaced by that term in each statement, all need to be present, but other features can also be present. Related terms such as 'comprise_ and 'comprised_ are to be interpreted in the same manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7).

The entire disclosures of all applications, patents and publications, cited above and below, if any, are hereby incorporated by reference.

This invention may also be said broadly to consist in the parts, elements and features referred to or indicated in the specification of the application, individually or collectively, and any or all combinations of any two or more of said parts, elements and features, and where specific integers are mentioned herein which have known equivalents in the art to which this invention relates, such known equivalents are deemed to be incorporated herein as if individually set forth.

Other aspects of the invention may become apparent from the following description which is given by way of example only and with reference to the accompanying drawings.

BRIEF DESCRIPTION OF THE DRAWINGS

Preferred forms of the present invention will now be described with reference to the accompanying drawings in which.

DETAILED DESCRIPTION OF THE INVENTION

Figure 1:
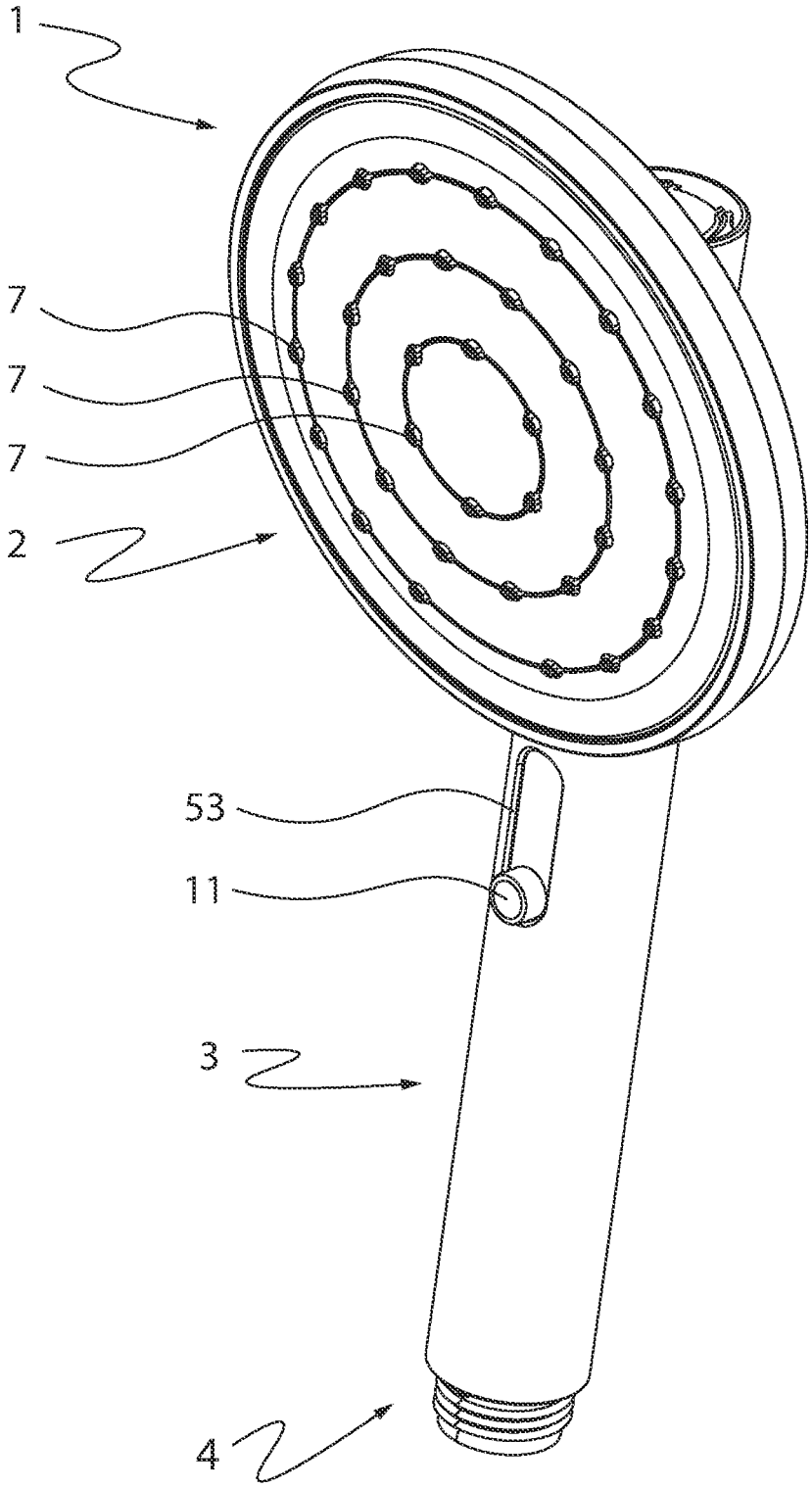
FIG. 1 Shows an isometric view of a first embodiment as a shower head, for example for holding from a rail, or by hand, FIG. 2 Shows a top view of the embodiment of FIG. 1, FIG. 3 Shows a front view of the embodiment of FIG. 1, FIG. 4 Shows at FIG. 4A a left view, and at FIG. 4B a right side view of the embodiment of FIG. 1, FIG. 5 Shows at FIG. 5A a rear view, and at FIG. 5B a bottom view of the embodiment of FIG. 1, FIG. 6 Shows a vertical cross-section along line AA of FIG. 2, FIG. 7 Shows a close up of the cross section of FIG. 6, with the valve as a sliding valve at one position, FIG. 8 Shows a further close up of the cross section of FIG. 6, with the sliding valve at another position, FIG. 9 Shows the external isometric view with the slide control button for the valve at the other position, FIG. 10 Shows an exploded isometric view of the embodiment of FIG. 1, showing the ring and cassette separate from the body or handle piece, FIG. 11 Shows a similar view to that of FIG. 10, from the opposing side, FIG. 12 Shows the embodiment of FIG. 1 in exploded isometric, FIG. 13 Shows the view of FIG. 12 from the rear, or upstream side, view, FIG. 14 Shows in close up isometric of the face plate with apertures from the rear, FIG. 15 Shows in close up isometric of the conical volumes plate from the rear, FIG. 16 Shows in close up isometric of the top plate from the rear, FIG. 17 Shows in close up isometric the face plate, conical volume plate, and top plate and cover plate from the front, FIG. 18 Shows in close up isometric view the front of the top plate, FIG. 19 Shows in isometric exploded view of the front of the cover plate, and FIG. 20 Shows in isometric section along line AA of FIG. 2 the valve body, cover plate and seal to the top plate for the two fluid flows for the first and second fluid flows, FIG. 21 Shows an isometric view of a second embodiment as a shower head, for example for holding from a rail, or by hand, FIG. 22 Shows a top view of the embodiment of FIG. 21, FIG. 23 a bottom view of the embodiment of FIG. 21
Figure 2:
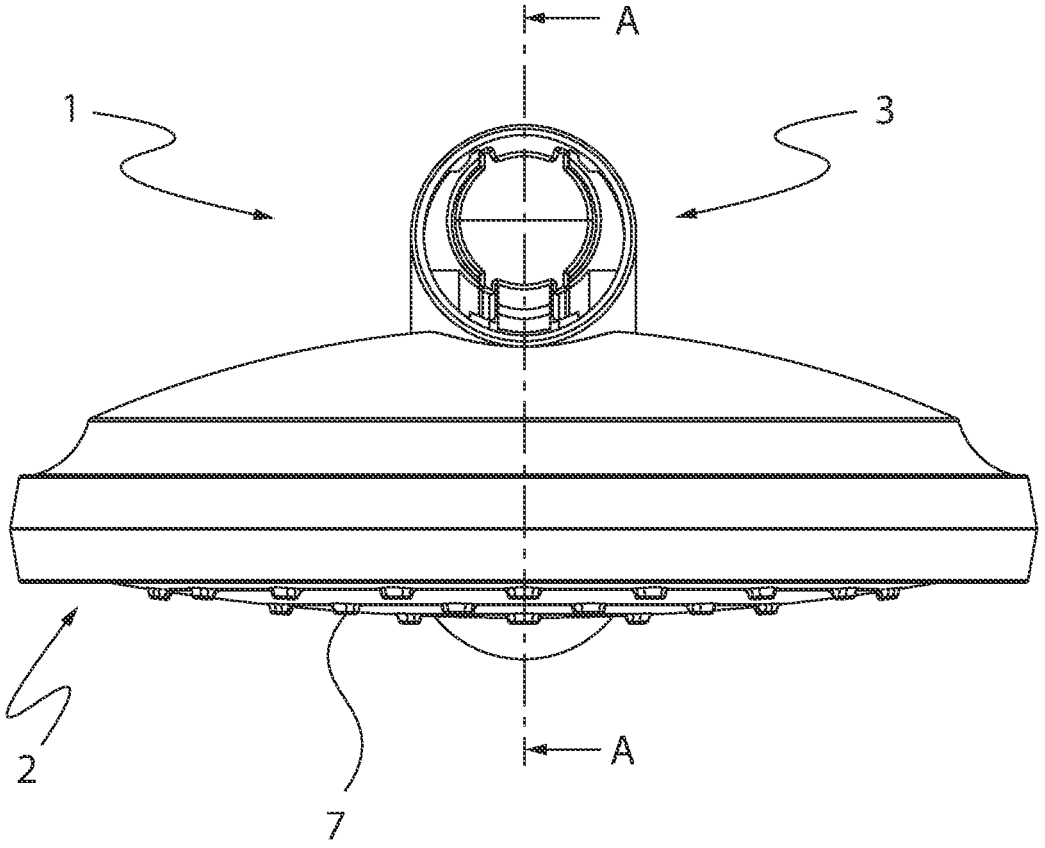
Figure 3:
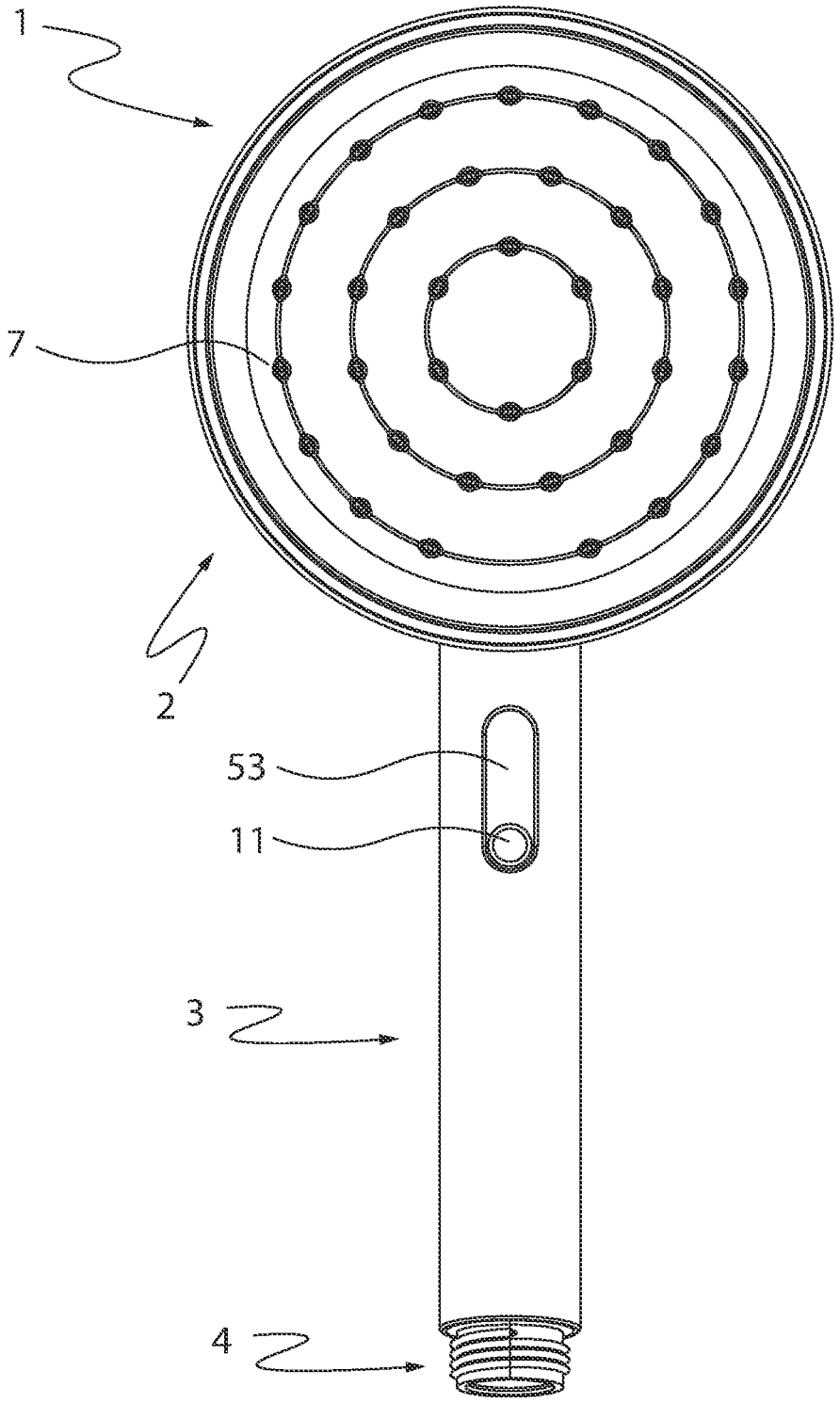
Figure 4A:
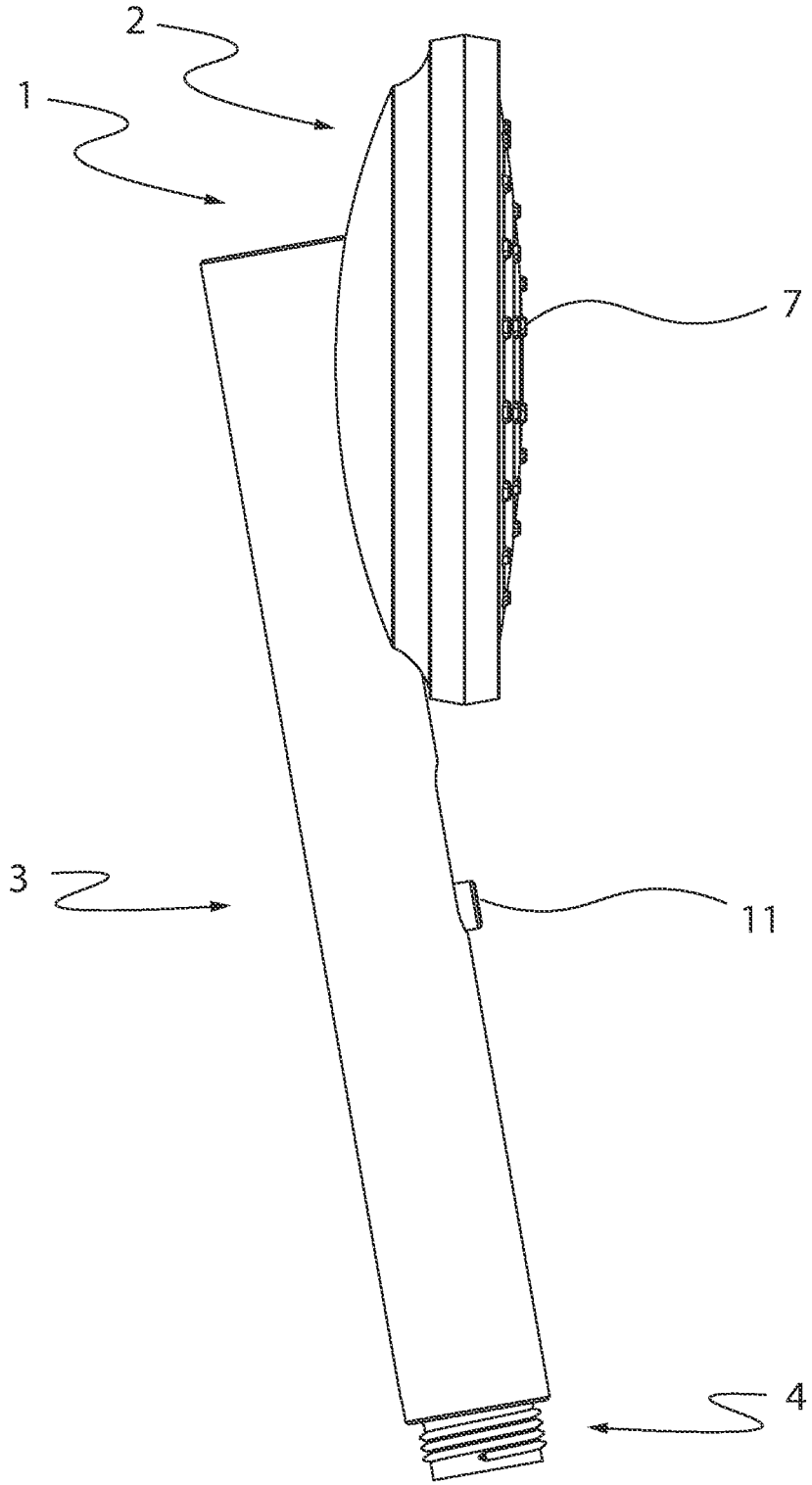
Figure 4B:
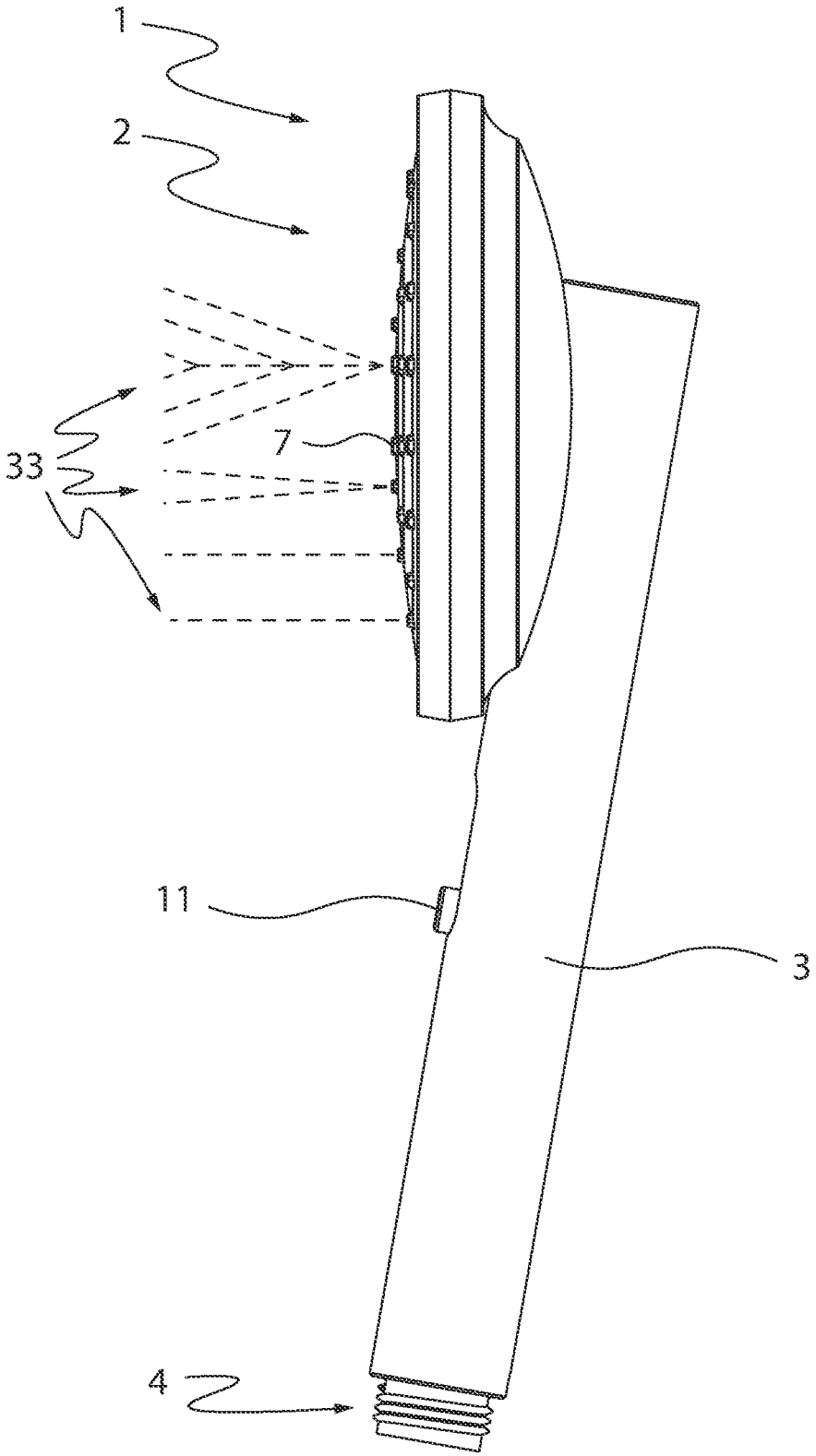
Figure 5A:
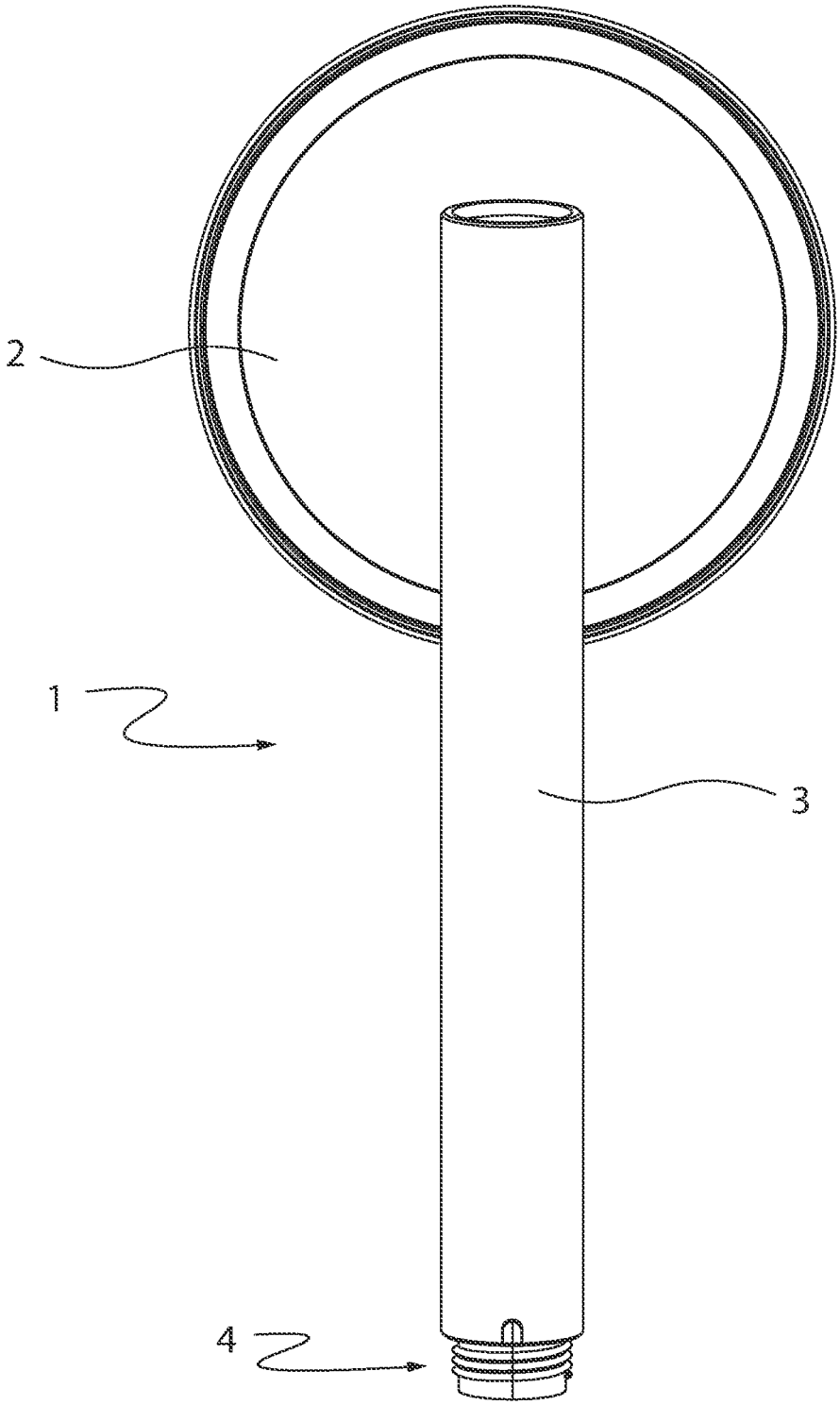
Figure 5B:
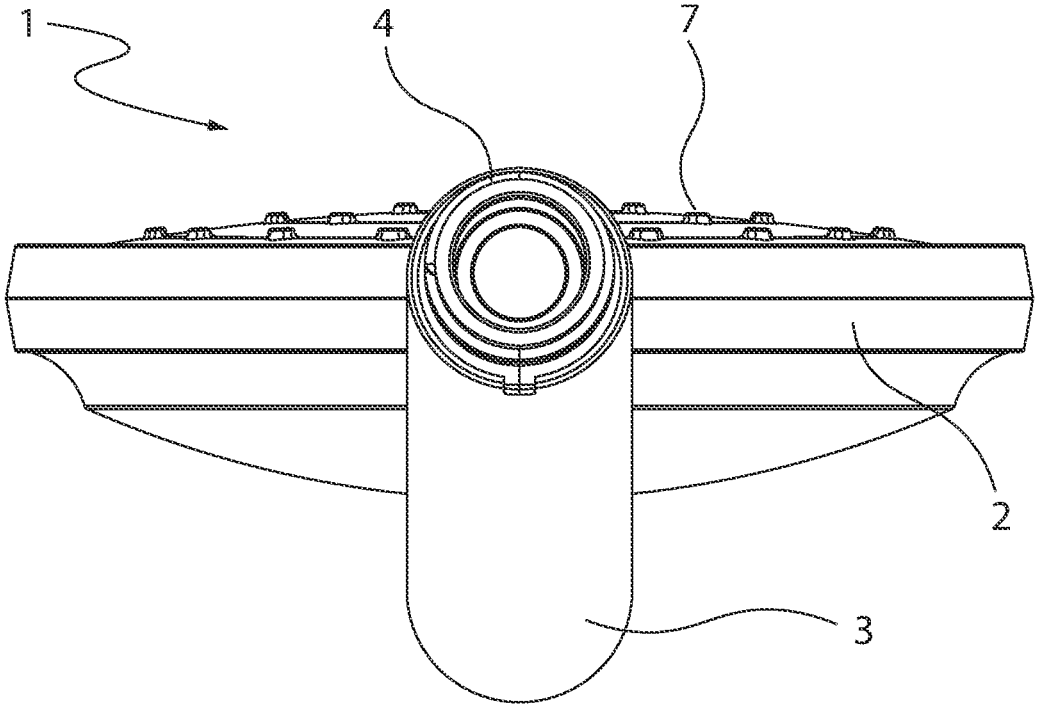

Preferred embodiments will now be described with reference to FIGS. 1 through 27.

The spray head 1 as shown in FIGS. 1 to 6 has a head portion 2 which is connected to a body portion 3. The body 3 has a connection 4 to a supply of fluid 5. For example the connection 4 as shown is a threaded connection, and the supply of fluid 5 may be from a tap, taps, mixer or similar such as that found in a shower, kitchen, bath, or similar location. The conduit to the connection 4 may be rigid such as in a shower head, or may be flexible such as when the spray head 1 is mounted on a rail or similar for movement, or holding separately by a user. Also any form of connection will suffice, not just a threaded connection.

The supply of fluid is preferably already mixed to the desired temperature and pressure or flow rate prior to arriving at the spray head.

One purpose of the spray head 1 is to vary the final output of the fluid to a user, so the user can choose the best flow of fluid, for example water, from the spray head. For example the user may want a very light spray or mist, or may desire a heavier flow such as to wash their hair or remove other cleansing products.

The spray head 1 has a control 11 as shown, which in the preferred form slides along the main axis of the body 3. The details of the function of the control 11 will be described shortly, but in summary moving the control 11 will vary the output of the spray 33 of the spray head 1.

Also shown in the head 2 is a plurality of outlets 7, in the example shown these are arranged in a series of concentric circles. However, the outlets 7 may be arranged in any desired pattern, including, but not limited to a row, or rows of straight lines, square, rectangular, triangular or whatever form is desired.

Also, while the head 2 as shown is a circular form, it also may take any shape as desired, including, but not limited to, multisided, hollow through its centre, or any other form as desired.

Figure 6:
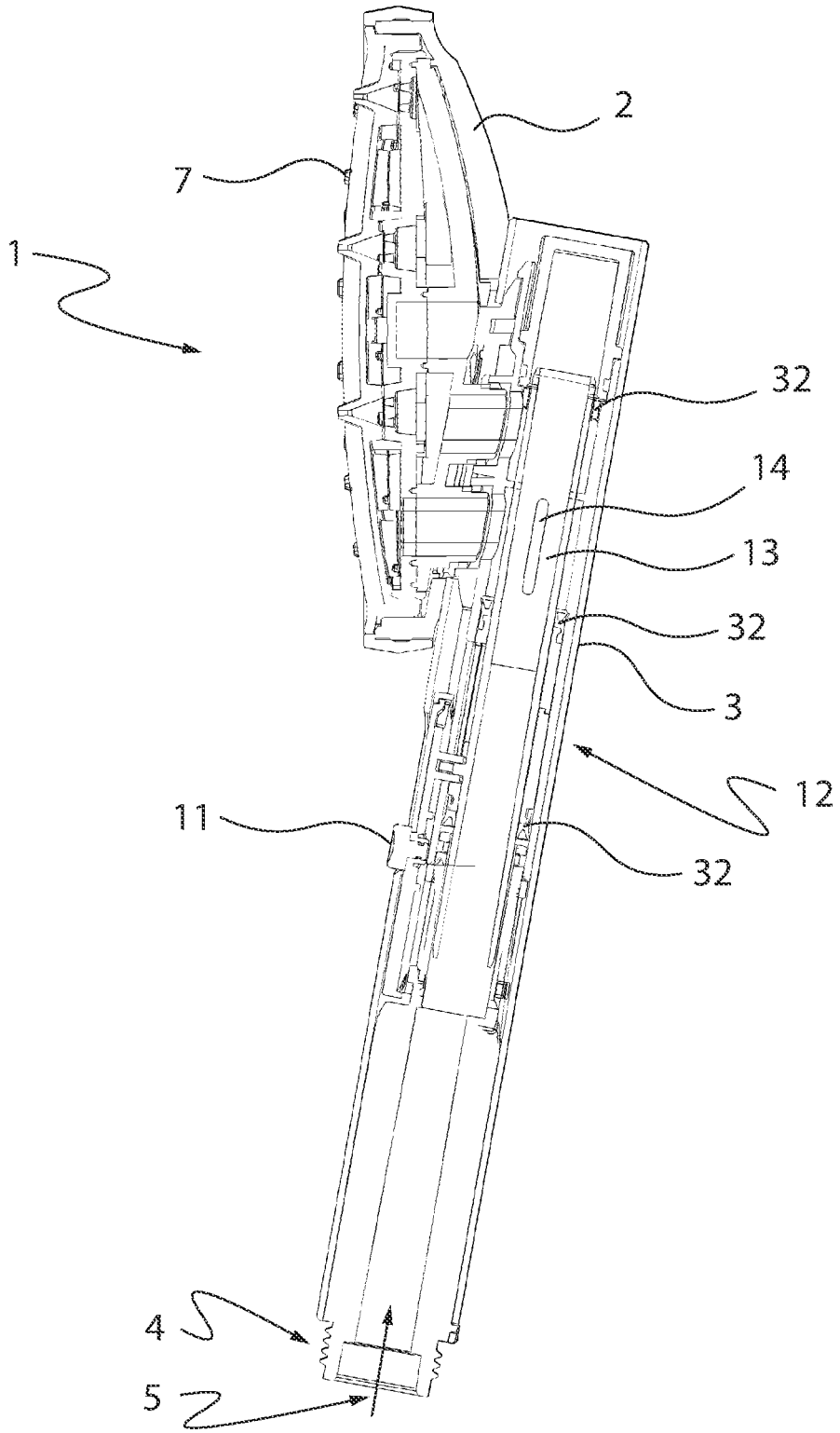
Figure 7:
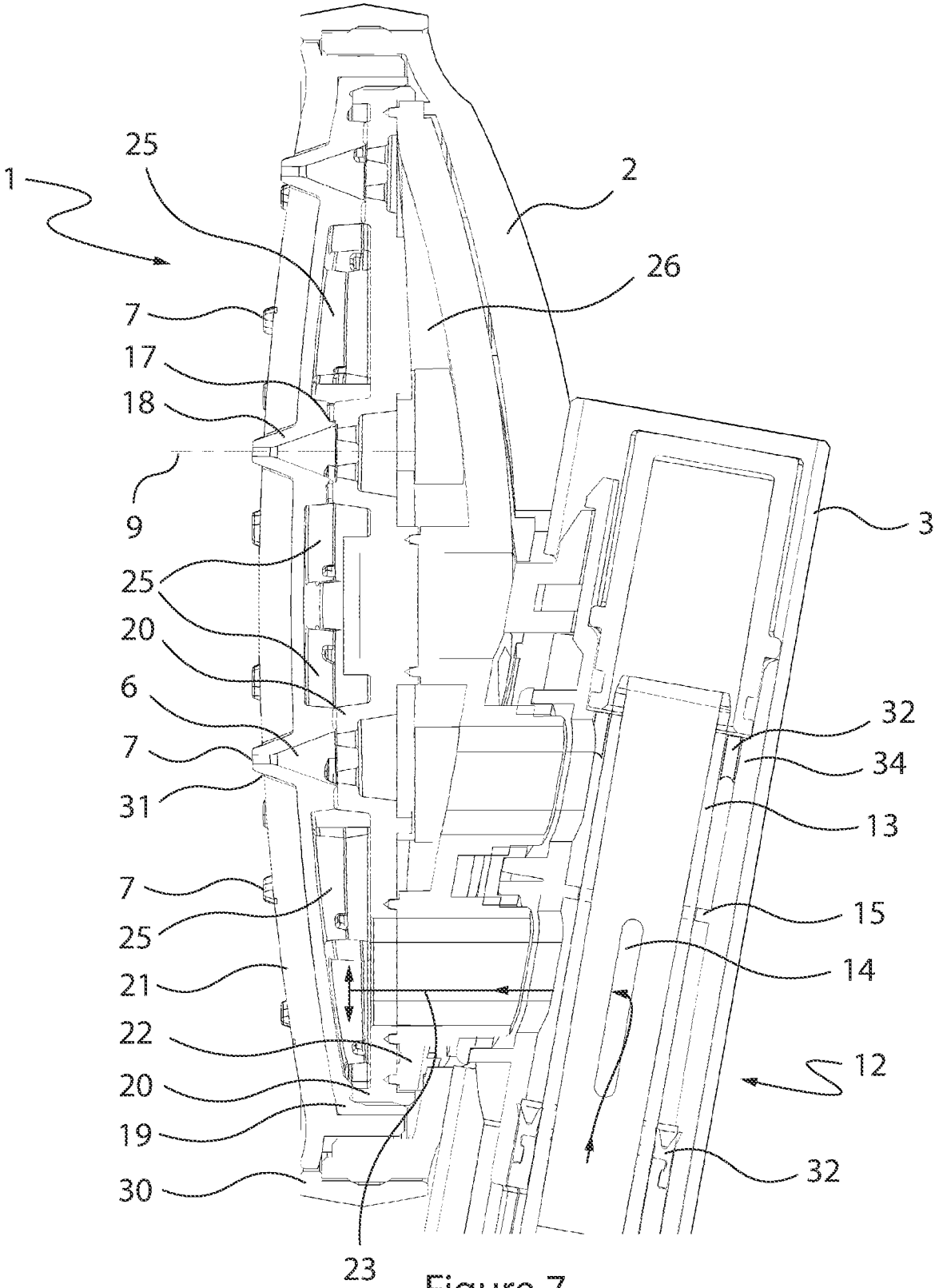

The path of the supply of fluid 5 into the body 3 via the connection 4 is shown in FIGS. 6 and 7. Entering the body 3 the fluid travels to a valve 12. In the preferred form the valve is a sliding valve, but could also be a rotary valve, or similar to divide and vary the supply of fluid between the first supply of fluid and the second supply of fluid as described below.

The sliding valve 12 in the embodiment shown has a valve body 13, which the control 11 slides along the main axis of the body 3. The fluid exits the valve body 13 through the valve aperture 14. Shown in FIG. 7 the fluid becomes a first supply of fluid and passes through the head to feed the first inlets. This will be described in more detail shortly.

The sliding valve body 13 has at least one seal 32 towards the lower end, and preferably a seal at the upper end also, to ensure water tightness, yet allow the valve body 13 to slide easily. In the embodiment shown these are lip seals 32. The control 11, seals 32, and valve body 13 are contained within a housing 34 which in singular or multipart form can slide into the body and be retained there. This allows for ease of assembly as well as replacement and maintenance. The housing and its assembly may slide in from either end, as necessary, of the body 3. A cap 36 covers the end of the body 3 distal from the connection 4.

In the preferred form, as shown in FIGS. 6 and 7 there is no seal of the fluid divider 15 against the exterior of the valve body 13. Rather the seals 32 define a sealed volume to prevent fluid exiting the volume. As there is no seal between the fluid divider 15 and the valve body 13 fluid is free to move between the first fluid supply 23 and second fluid supply 24, even when the slider and valve body 13 are at the two extremes of their movement. This allows balancing of the pressure between the two supplies. Further in one form of the preferred form of the present invention, even when the valve body is at the extreme of its movement to supply the first fluid supply, there is still part of the valve aperture 14 exposed to supply fluid to the second fluid supply, and vice versa.

Another way of achieving the pressure balancing is to adjust the clearance between the fluid divider 15 and the valve body 13. In yet another way is to remove the top lip seal 32 (farthest from the inlet of the fluid supply 5) to allow a portion of fluid to always flow to the second supply. This is possible as the top lip seal 32 can be optional in that it only seals between the two fluid supplies and not to the outside of the spray head. In this way the level of spray adjustment can be tuned by the size and shape of the valve aperture 14, the clearance between the fluid divider 15 and the valve body 13 and the presence (or not) of the top lip seal 32.

The ability to define and tune the adjustment range of the spray is achieved by allowing a defined amount of water to always flow to the second supply. This controls how fine the spray goes at maximum adjustment—more flow to the second supply makes it less fine and vice versa. If the two flows are completely separated then the spray would be too fine at full adjustment.

Figure 8:
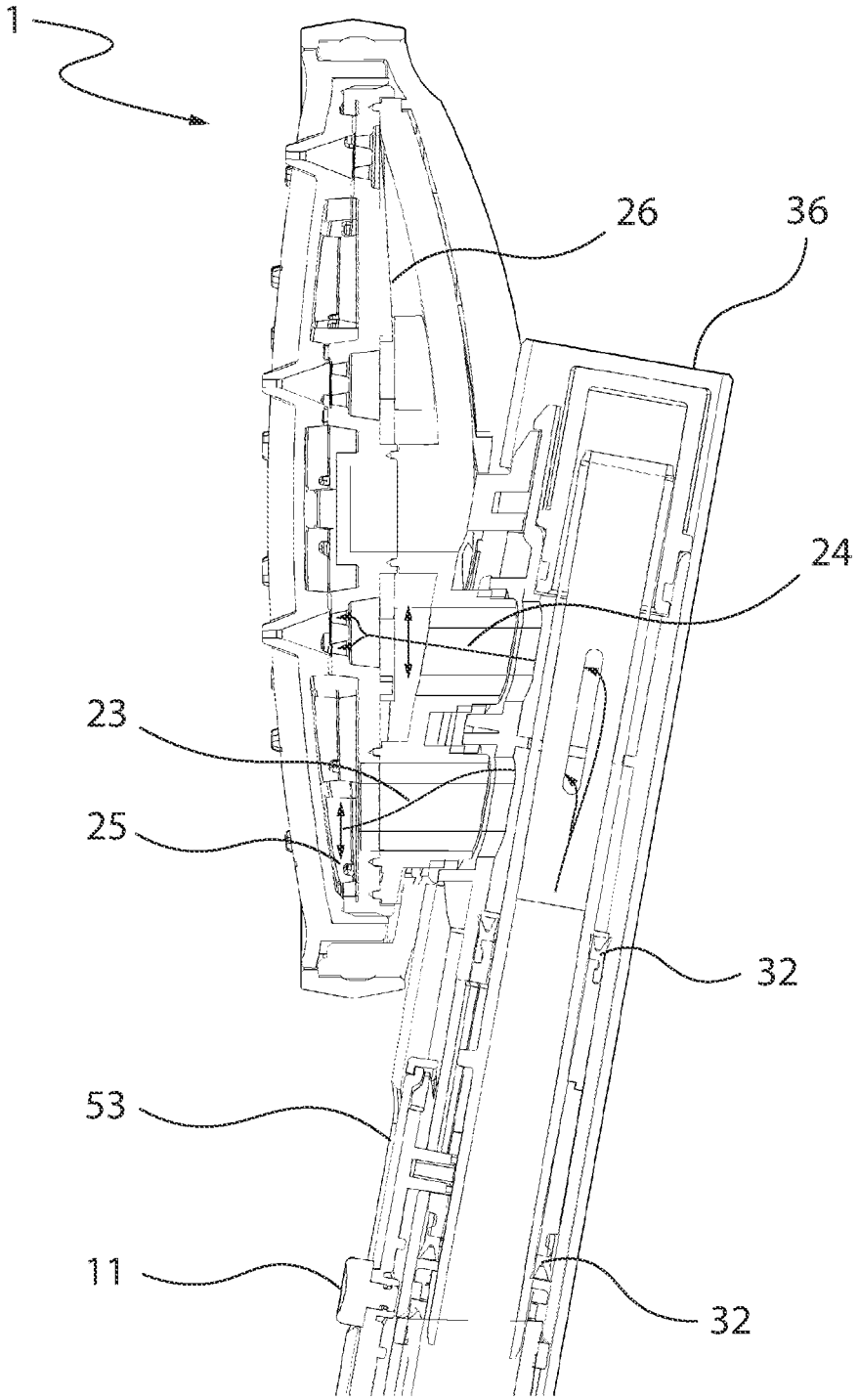
Figure 9:
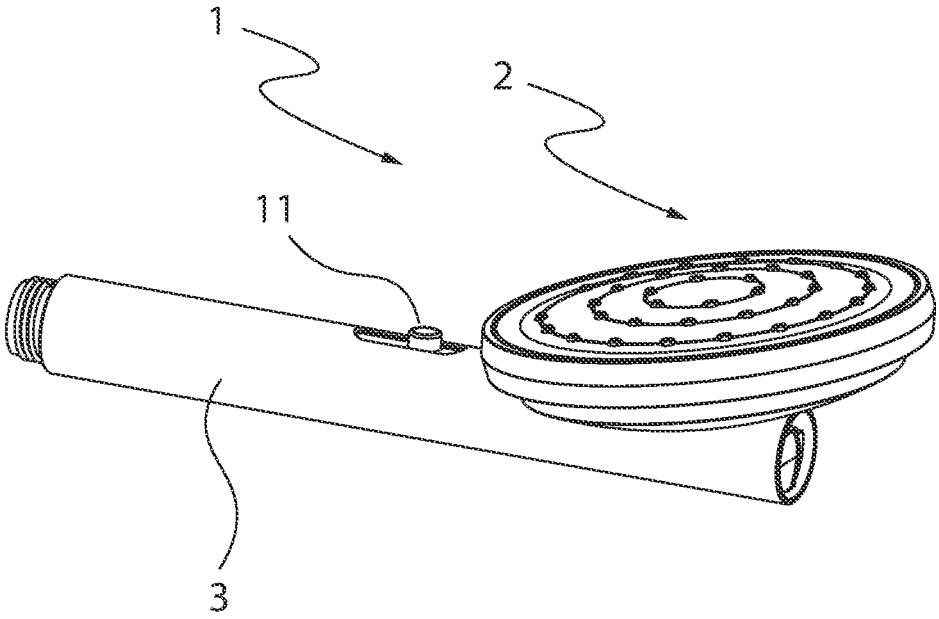

Shown in FIG. 8 the control 11 and hence the sliding valve 12 and valve body 13 have been moved (upwards in the figure as shown) such that the valve aperture 14 now sits across a fluid divider 15. In doing so the fluid passing out the valve aperture 14 is now divided, into the first fluid supply 23 and a second fluid supply 24. The relative position of the valve aperture 14 across the fluid divider 15, moved by the control 11, will vary the ratio of the first supply or fluid 23 and the second supply of fluid 24. Stops may also be present to control the ends movements of the valve body 13, or may be provided by the length of the slot 53 in the body 3.

Figure 10:
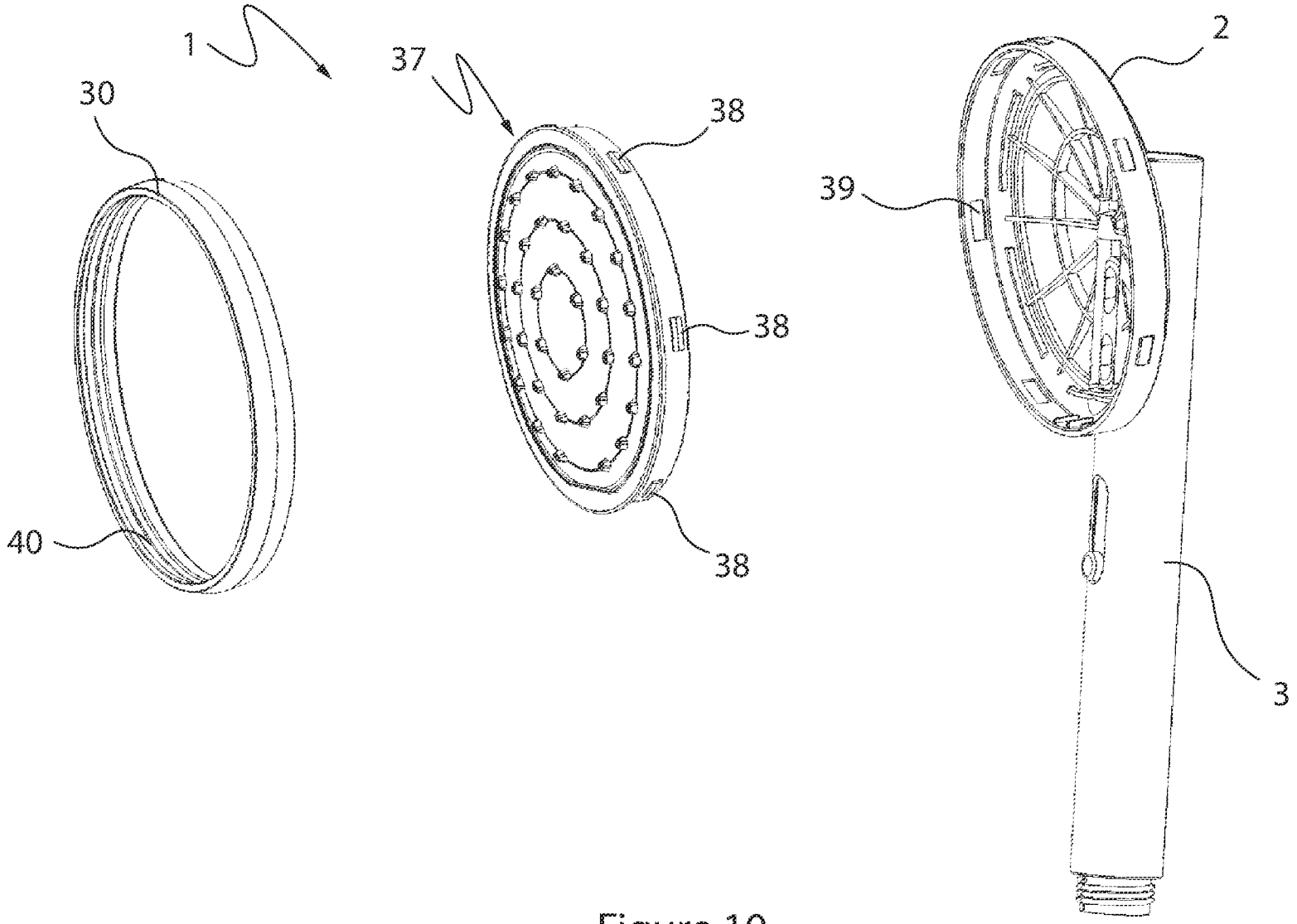
Figure 11:
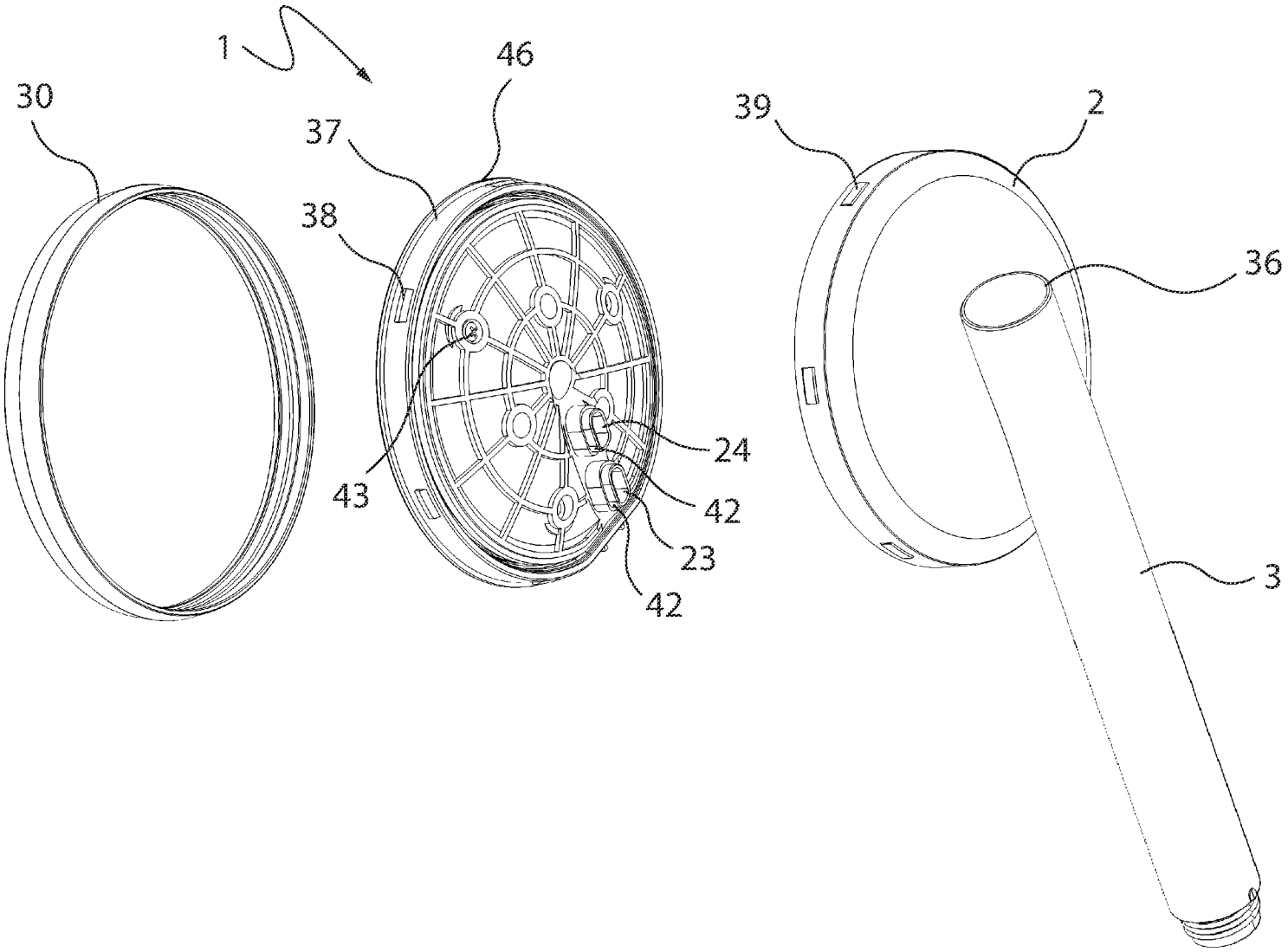

Shown in FIGS. 10 and 11 is a partially exploded view of the spray head 1. The spray head 1 is exploded into a connection ring 30 that acts as a trim, cassette 37 and the head 2 and body 3. In the preferred embodiment the cassette mounts into the concavity of the head 2, and has clips 38 that protrude from its periphery. The clips 38 are further shown in FIG. 14, and are part of the face plate 21 (described later). The clips 38 in the form shown are ramped on their leading edge, and are stepped on their trailing edge. This will be understood when it is known that the clips 38 engage in complimentary recesses 39 in the interior of the head 2.

In the preferred form shown, the recesses are apertures through the periphery of the head 2, such that the clips 38 can engage in them. The connection ring 30, can also clip separately into place to form a trim.

In another form the recesses 39 may be apertures through the periphery of the head 2, such that the clips 38 extend partially beyond the periphery surface of the head 2 when engaged in the recesses 39.

The connection ring 30, may be able to rotate, or prevented substantially from doing so by friction, or may have abutment portions in the ring that engage or otherwise to prevent rotation. In this embodiment the connection ring 30 is largely for aesthetics, but also covers the join between the cassette 37 and the head 2, and smooths the assembly. By covering joins and part lines it also helps prevent build-up of scale or dirt, and aids in resisting the pressure on the clips.

Figure 12:
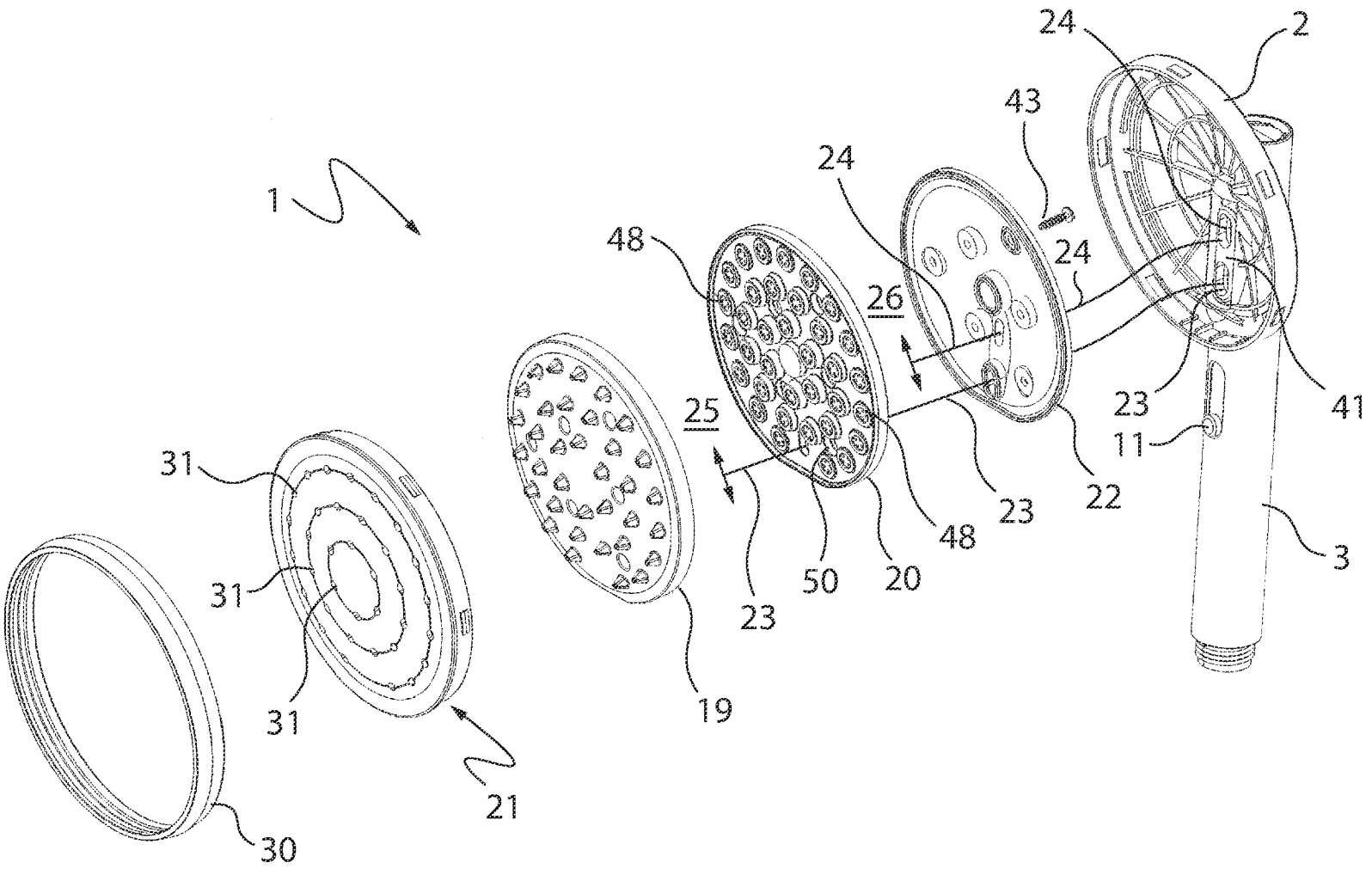
Figure 13:
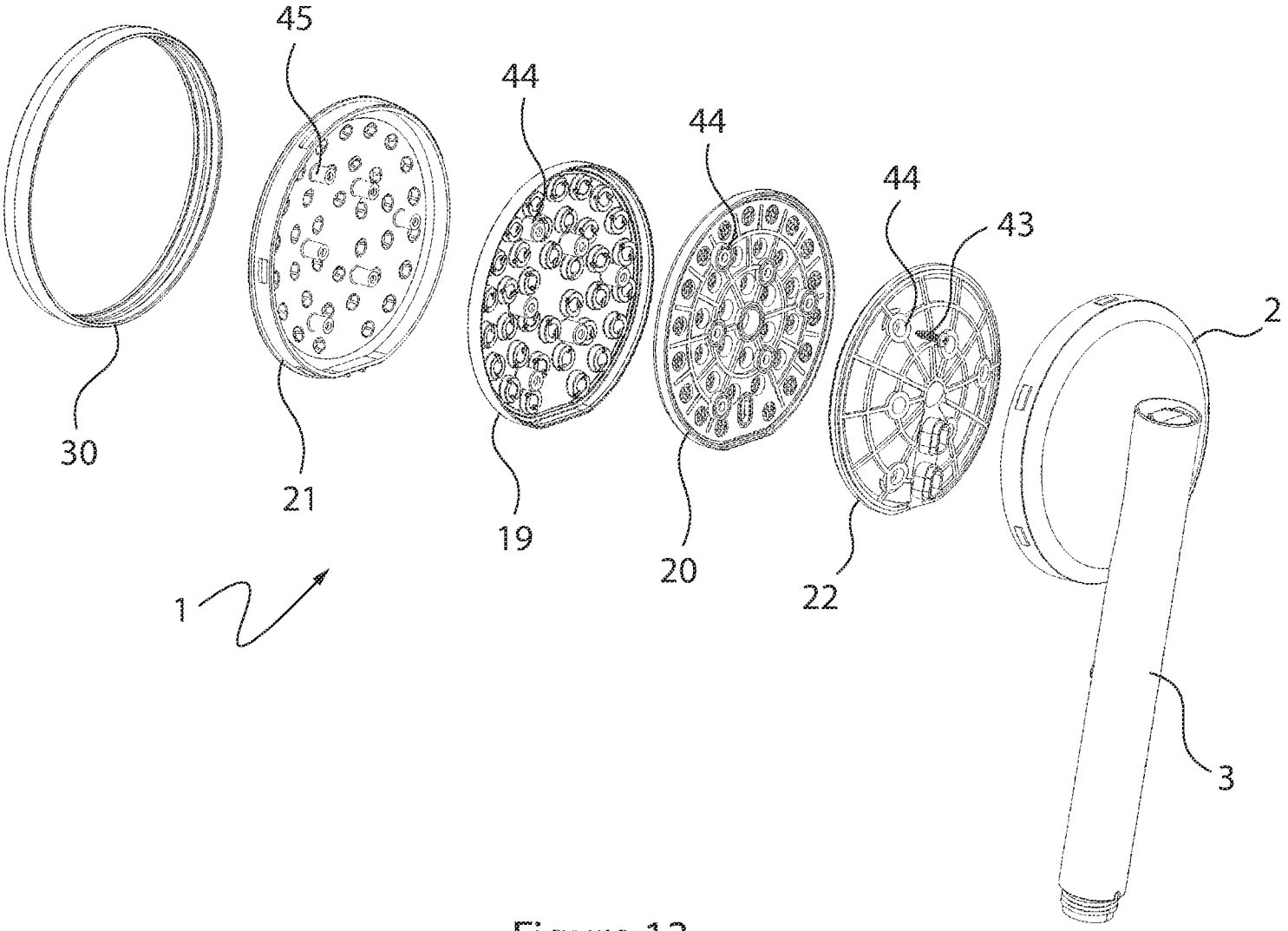

The first fluid supply 23 pathway and second fluid supply 24 pathway from the body 3 and head 2 can also be seen in FIGS. 10 and 11, with the head seal 41 which fluidly seals the cassette 37 to the head 2. In FIGS. 8, 11, and 12, the first fluid supply 23 pathway and second fluid supply 24 pathway in the cassette 37 (in this case in the cover plate 22 of the cassette) are visible, with the land 42 for the head seal 41. In other forms the cassette 37 may be a threaded fixing into the head 2, or may be adhered thereto by glue, welding or other known methods. The recess and aperture method allows for easy assembly, and if desired maintenance or replacement. The face plate 21 that forms the front of the cassette 37 has a ring 46 that abuts against the front of the head 2 when engaged therein. This acts as a guide and a stop to show the cassette 37 is correctly installed or engaged.

The cassette may be supplied as a standalone item that is sold separately to convert other spray heads, or as a maintenance item to replace a worn, faulty, or blocked cassette 37.

Visible in FIG. 11 also is a fastener 43 that holds the cassette together. In the preferred form there are six such fasteners 43 and the further apertures to receive the other fasteners (not shown) are visible.

FIGS. 12 through 20 show the exploded cassette 37 components and close up detail of each of these. Looking at FIG. 12 there is the face plate 21, conical volume plate 19, top plate 20, and cover plate 22, and one of the fasteners 43 that holds the components nested to form the cassette together. As can be seen the fasteners 43 are provided with fastener apertures 44 through the cover plate 22, top plate 20, conical volume plate 19 and thread-wise engage in a boss 45 in the back side of the face plate 21. The fasteners 43 when engaged and tightened hold the cassette together and, because of the resilient nature of the conical volume plate 19, seals the cassette so that fluid only exits the outlets 7.

Figure 14:
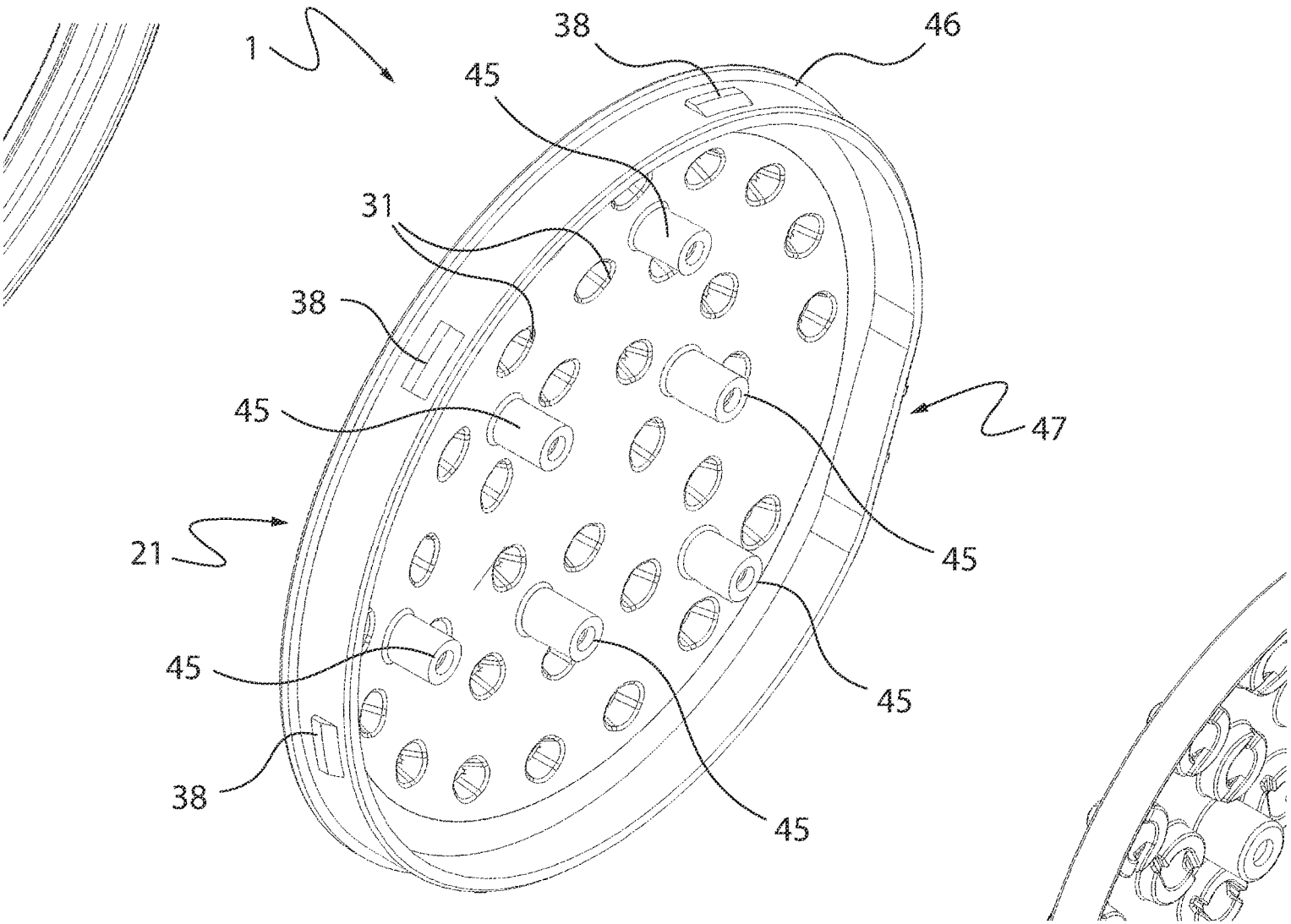

FIGS. 12 and 14 show the front and rear sides respectively of the face plate 21. As described earlier the clips 38 are visible on the plate periphery. The face plate 21 is concave and, as described earlier, nests the conical mixing plate 19, and top plate 20. Visible also are the face plate apertures 31 that allow the outlet 7 from each of the conical mixing volumes 6 of the conical volume plate 19 to extend there through. In this instance the face plate apertures 31 are arranged as 3 concentric circles to match the outlets of the conical mixing volumes 6 from the conical volume plate 19. The face plate apertures 31 are complimentary to the external shape of the conical mixing volumes 6, as can be seen in the cross section in FIG. 7. This is in part to support the conical mixing volume, and also to provide a surface to sandwich the conical mixing volume 6 against the front side of the top plate 20. In the preferred form the remainder in the interior or back surface of the face plate 21 conforms to the front or exterior of the conical volume plate 19 to support it.

Common to all the components of the cassette is a flattened bottom portion 47, which helps register the cassette and components in the head 2.

Figure 15:
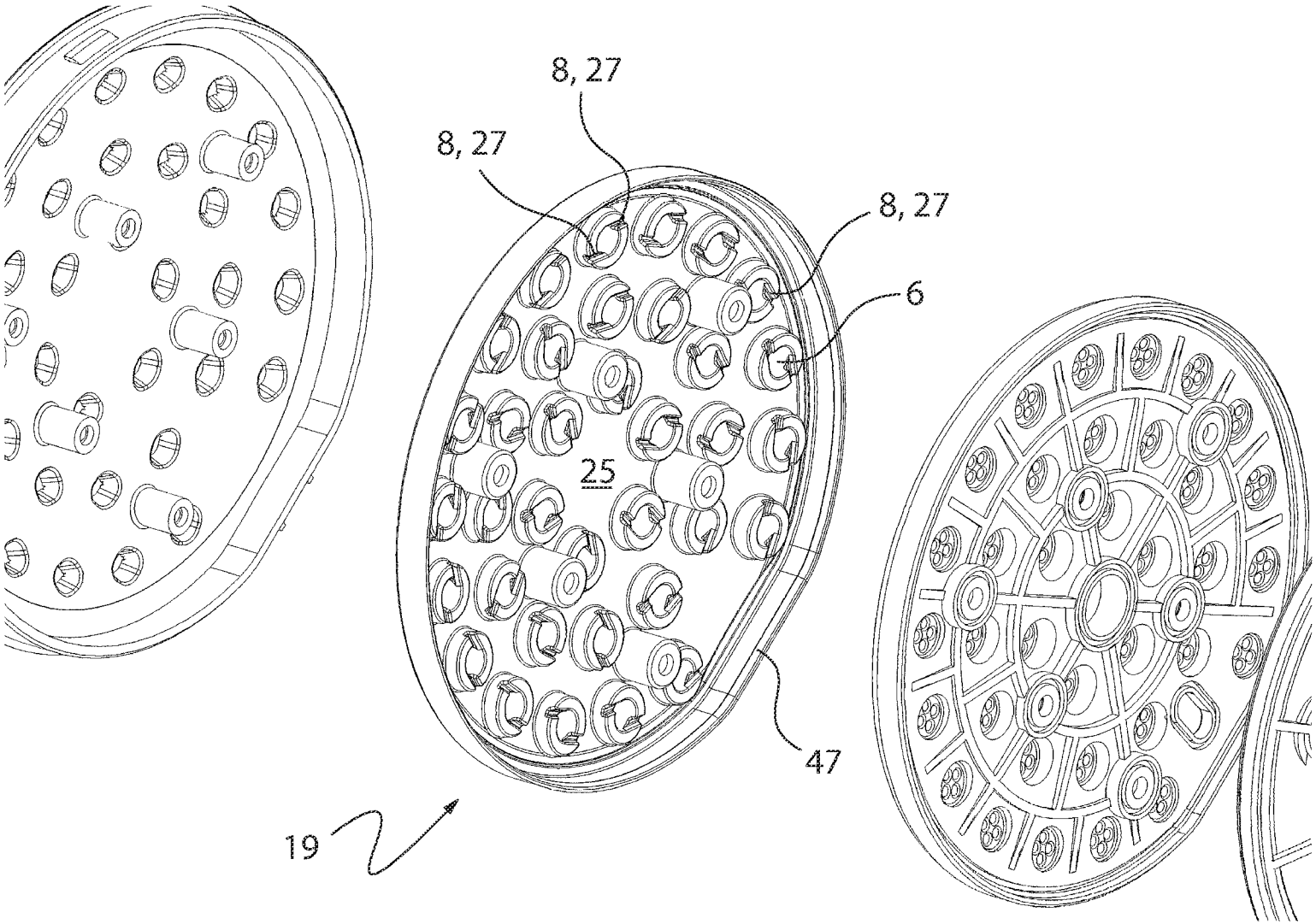

Shown in FIGS. 12 and 15 is the conical volume plate 19, so named as it is a unitary plate in the preferred form that holds all the conical mixing volumes 6. Alternatively there may be individual conical mixing volumes 6 that are each separately sealed to the top plate 20, however this is not the most desirable from a manufacturing or reliability aspect. In the preferred form, the conical mixing plate 19, and thus the volumes 6, is made from a resilient material, such as rubber, thermoplastic urethane, or similar, at least on its external surfaces. The entire plate 19 may be made of the same material, or may be over- or co-moulded to provide the external sealing material. This is to allow the conical mixing volumes therein to fluidly seal at least to the top plate 20.

The conical mixing volumes have first inlets 8 (as channels 27) and second inlets 10 (as inlet apertures 54) at or near their base 17, and the outlet 7 near the peak 18. In this way the interior of the conical mixing volume 6 tapers and reduces in size as the fluid moves from the inlets 8, 10 to the outlet 7, as seen in FIG. 7. In the preferred form the taper is between 0 and 180 degrees, and in the preferred form is 40 degrees.

In the preferred form the outlet 7 extends as a tube for a short length as seen in FIG. 7. In the preferred form the tube length is approximately 0.5 to 4 times the length of the outlet 7 diameter, and in the most preferred form is approximately twice the tube diameter.

The connecting material between the volumes 6, lies at least in part below the base 17 and above the peak 18 of the conical mixing volumes 6, such that the front, or external surface has the exterior of the conical mixing volumes 6 extending therethrough. The plate 19 also has the fastener apertures 44 to allow passage therethrough of the fastener 43 to engage the bosses 45. Clear in FIG. 7 is the nesting of the plate 19 with the face plate 21. Again, the flat bottom portion is evident.

The backside or interior of the conical volume plate 19 is shown in FIG. 15. The conical mixing volumes 6 extend into the interior also, due to the location of the connecting material between the conical mixing volumes 6. Therefore, when the conical volume plate is sandwiched against the top plate 20 and forms a first fluid volume 25 between the two. The first fluid volume 25 is fed from the first fluid supply 23.

Shown in FIG. 15 each of the conical mixing volumes 6 has at least one, and preferably a pair, of channels 27, though more may be used as desired. The open back of the channels seals against the front of the top plate 20 when assembled thereto. The result is a channel 27 that forms a first inlet 8 into or near the base 17 of the conical mixing volume 6. As can be seen the channel 27 and therefore the first inlet 8 is perpendicular to the conical axis 9, and lies at a tangent to the conical axis 9. In this way fluid entering the conical mixing volume 6 creates a swirl or rotation in the volume 6.

Therefore an increase of the first fluid supply relative to the second fluid supply creates a stronger jet at the first inlets 8 to the conical mixing volumes 6. The interior periphery of the plate 19 seals to the exterior periphery of the top plate 20, as seen in FIG. 7, to envelope and fluidly seal the first fluid volume 25.

Shown in FIGS. 12, 17, 18, and 16 are the front and back sides of the top plate 20, respectively. The top plate 20 is preferably made from a substantially rigid and resilient plastics or similar material. Plastic is desirable as it is easily moulded and finished and is cost efficient, though other materials, such as metal or similar may be used. The top plate has a series of inlet portions 48 that seal against the base of the corresponding conical mixing volume. The extension of each of the inlet portions 48 varies to match the curved aspect of the conical mixing plate 19 so that equal pressure is put on each base. On the back side of the top plate 20 there are reinforcing ribs 49 to strengthen it so that it is stiff enough to impart the sealing pressure on the conical mixing volumes to the front side of the top plate 20 to seal the channel 27. The front side of the top plate 20 also has plate recesses 50 to receive the plate bosses 51 from the conical volume plate 19. This further seals and defines the first fluid volume 25.

Each inlet portion 48 has between 1 and 8 second inlets 10, and in the preferred form shown there are 4 second inlets 10. The second inlets 10 are fed from a second fluid volume 26 which is defined between the back of the top plate 20 and the front of the cover plate 22. The second fluid volume 26 is fed by the second fluid supply as it varies under control of the sliding valve 12, fluid divider 15 and valve aperture 14. The periphery of the top plate 20 back surface seals on against the front surface periphery of the cover plate 22, as seen in FIG. 7. Additional seal element, such as o-rings or similar (not shown) may be present to effect the seal. When the top plate 20 mounted against the conical volume plate 19 the second inlets 10 are upstream of their respective first inlets 8.

Figure 16:
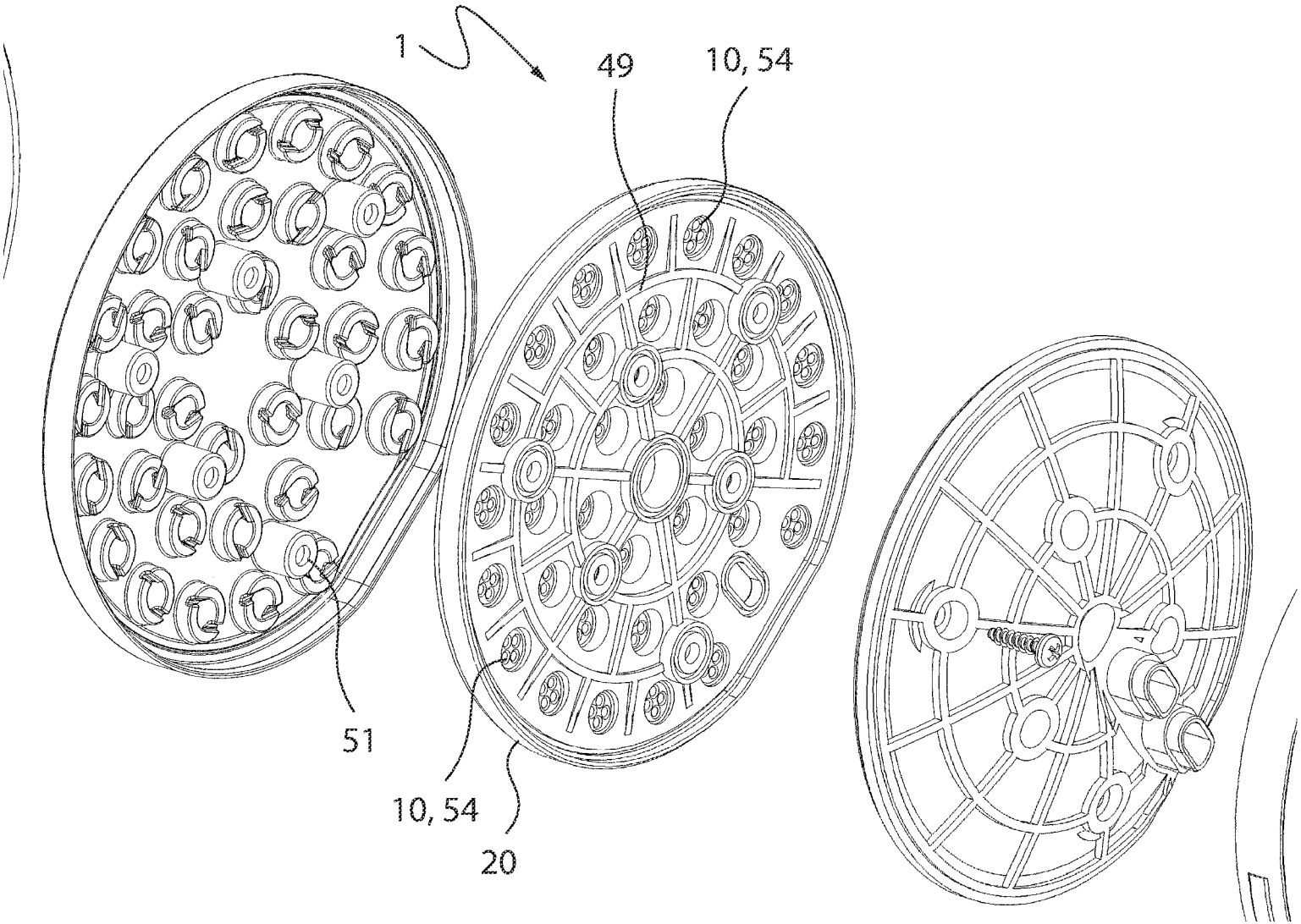
Figure 17:
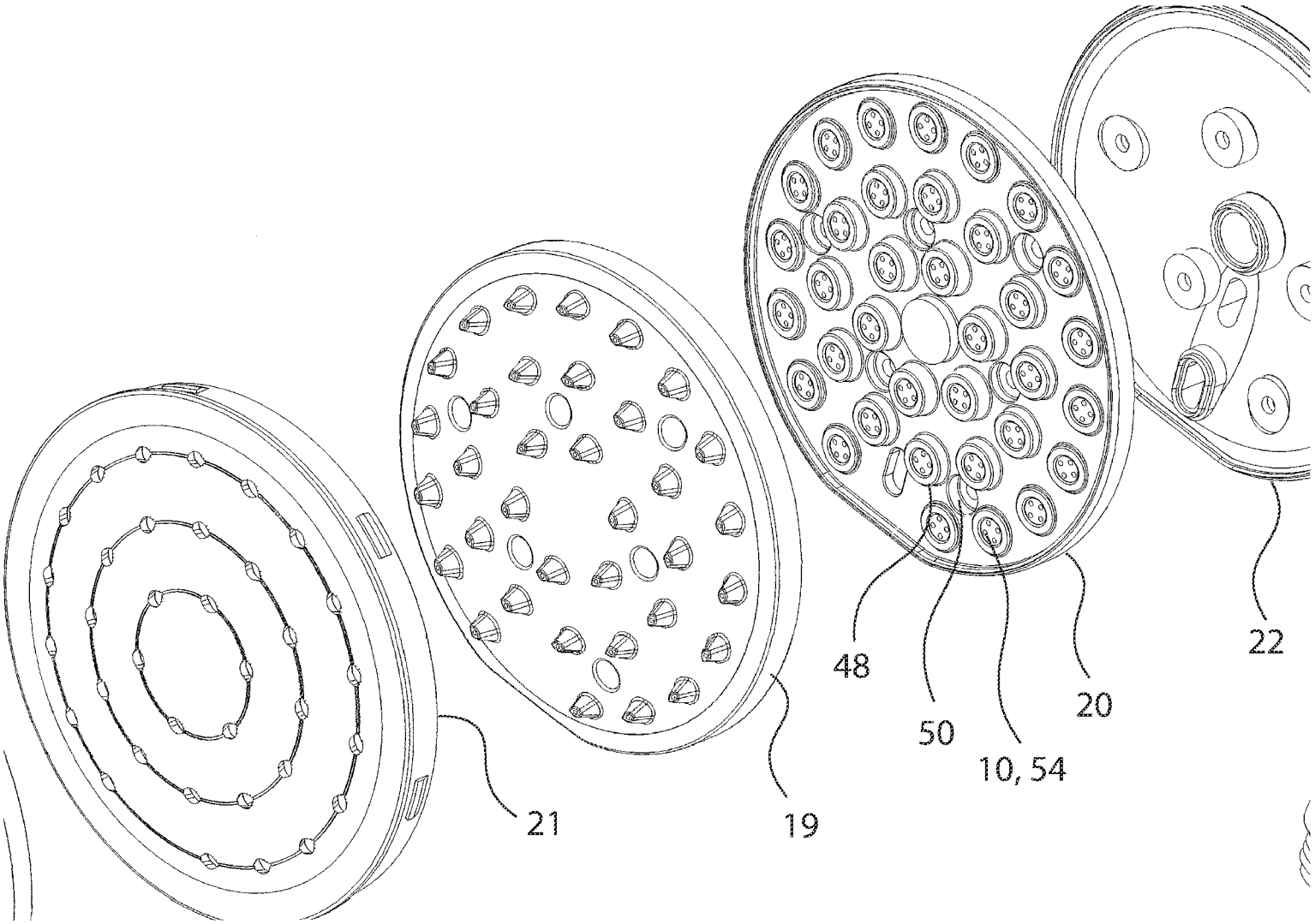
Figure 18:
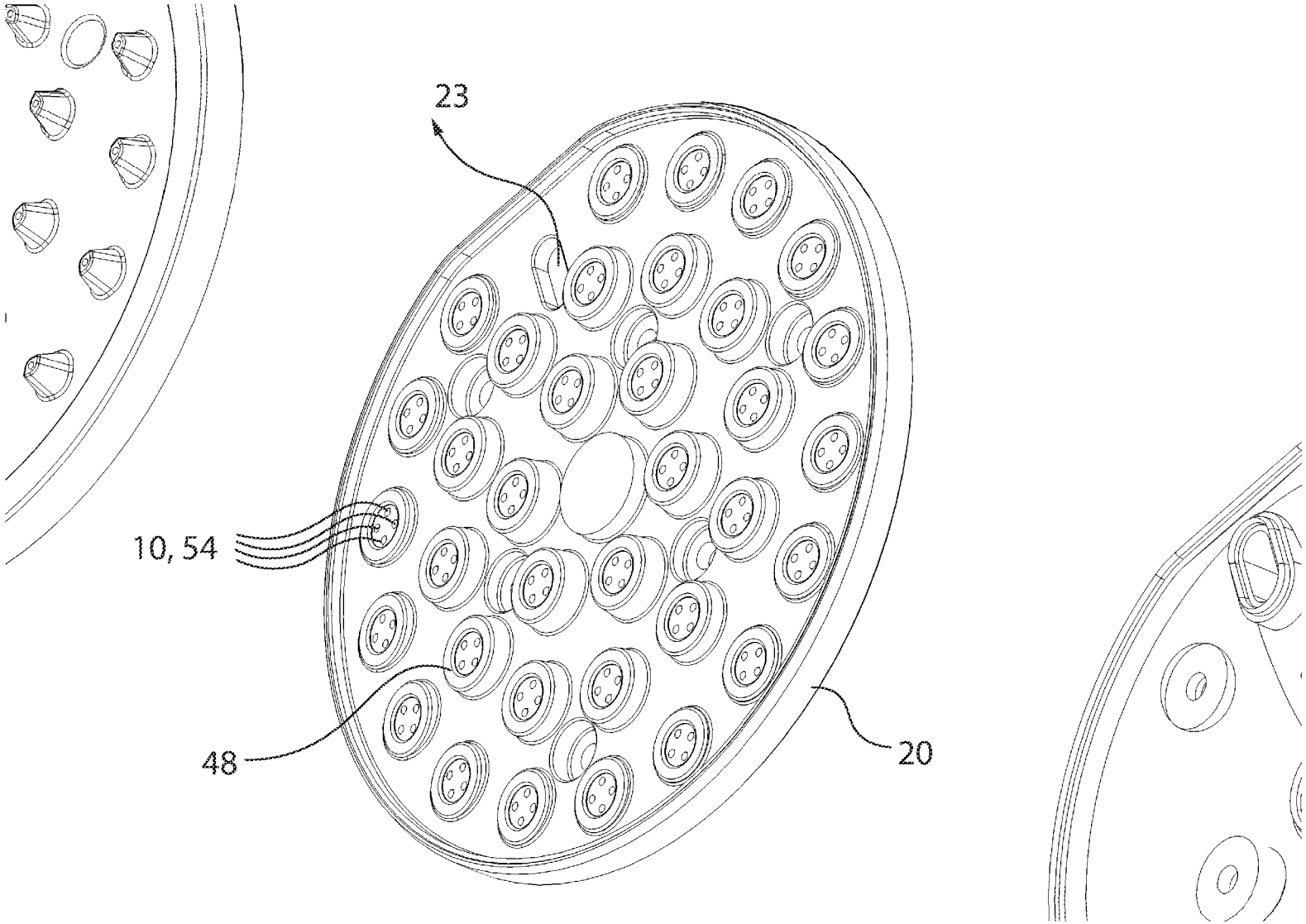

The configuration of four inlet apertures, as seen for example in FIG. 16, that form the second inlet 10 gives a better spray when water is coming from both the second inlet 10 and the first inlet 8. However, the number may vary between 1 and 10 inlet apertures depending on the relative pressures and mixing volume. When a single central aperture is used for showering volumes and pressures, any flow of water from the second inlet causes the spray at the outlet 7 to break up into a poorly controlled cone. Whereas the four apertures appear to cause less disruption to the circular flow of water from the first inlets 8 (or as channels 27) which gives a cohesive cone and a more tidy spray from the outlet 7.

This may be due to the fact the centre of the spinning water in the conical mixing volume 6 has a low velocity so it is easily made turbulent by a single jet coming from the second inlet 10, whereas four apertures around the perimeter release water under lower pressure, but similar volume to the fastest moving part of the spinning water so the effect is more gradual.

This along with the extended tube for the outlet 7 reduce the size of the resultant spray cone and give a more tidy, focused spray.

Figure 19:
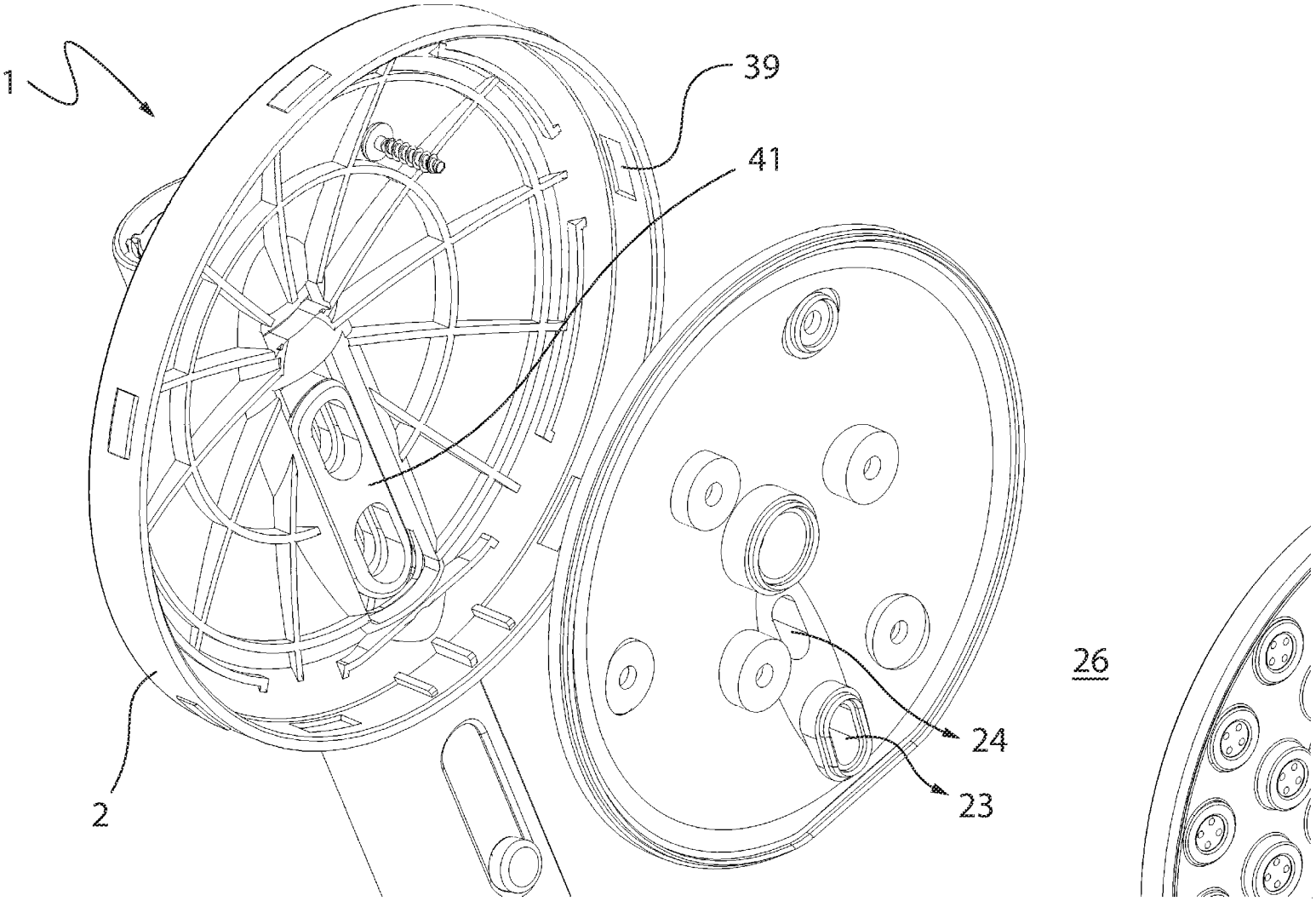
Figure 20:
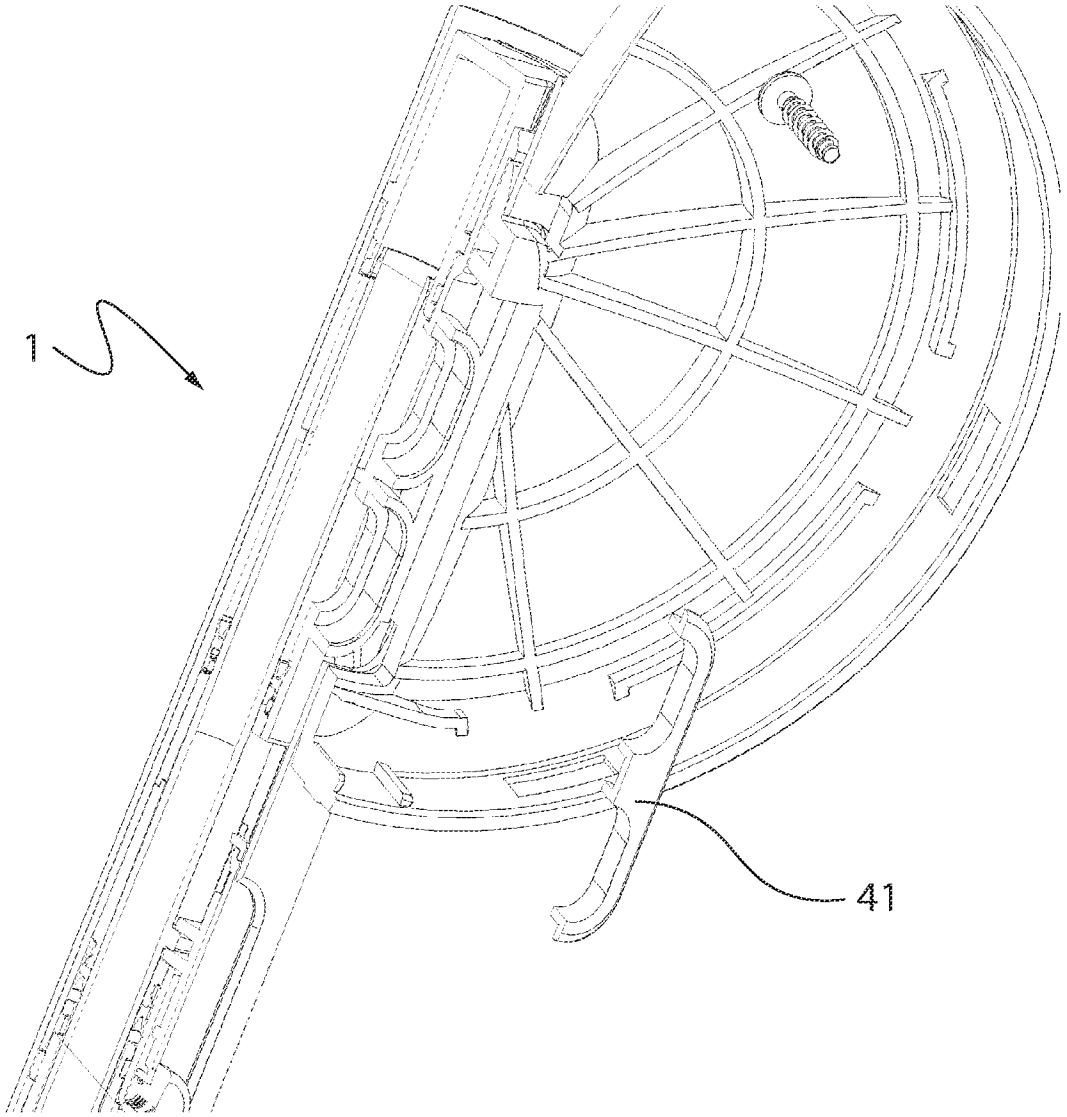
Figure 21:
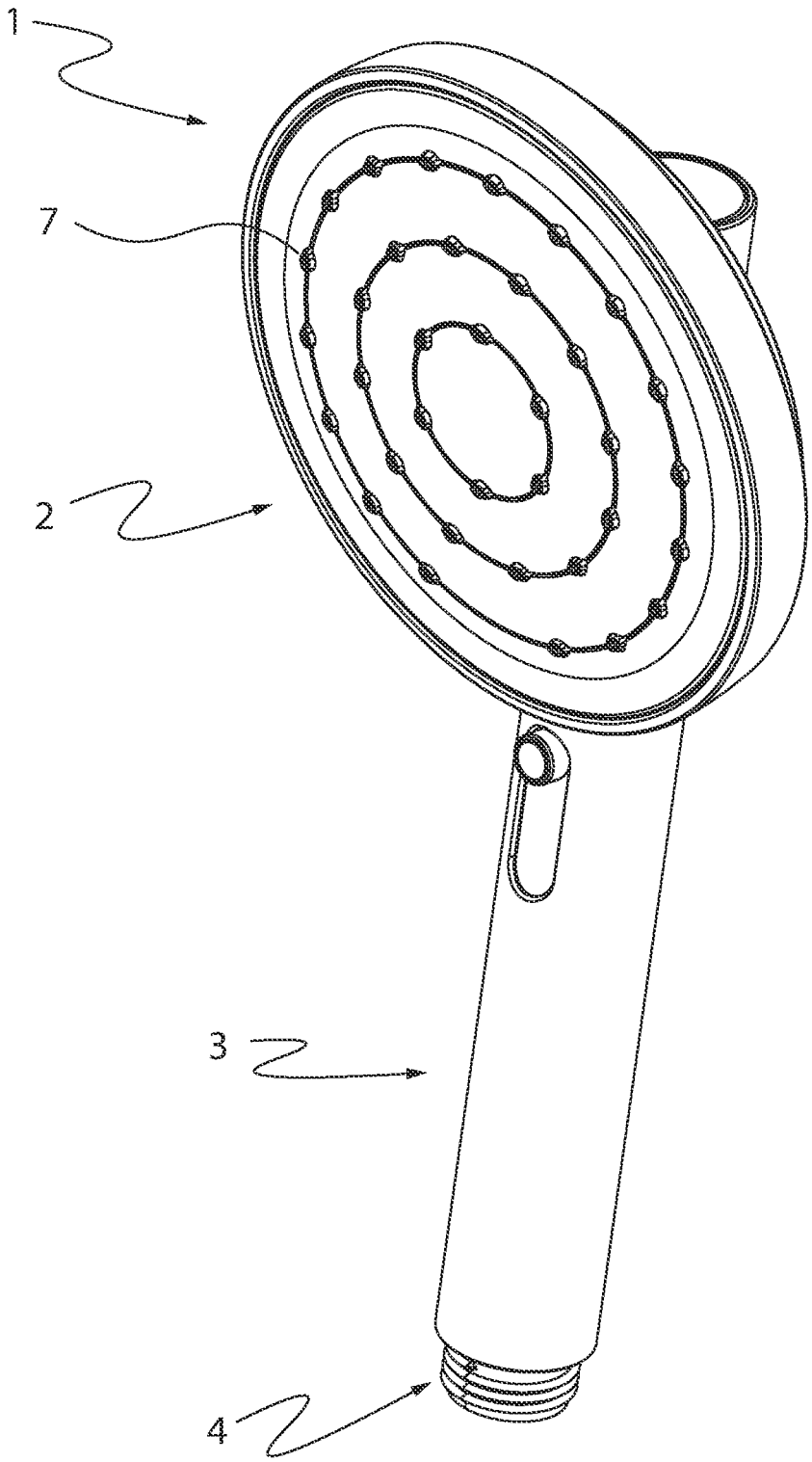
Figure 22:
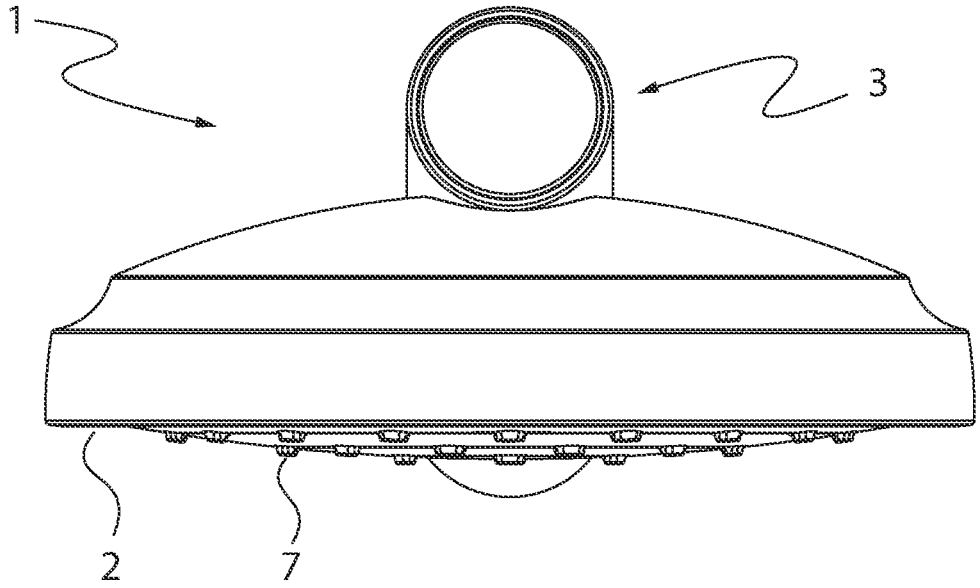
Figure 23:
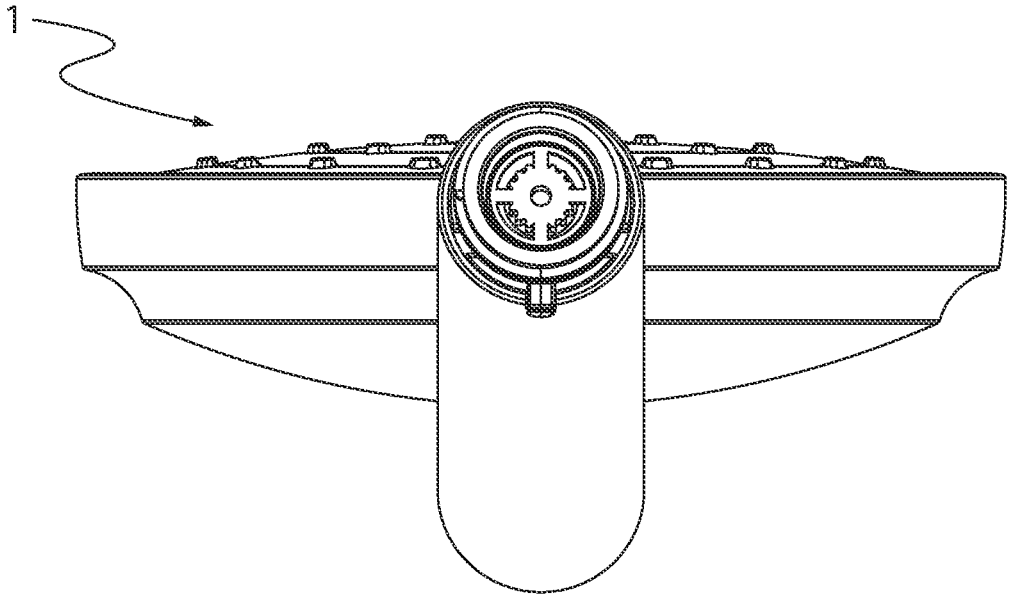
Figure 24:
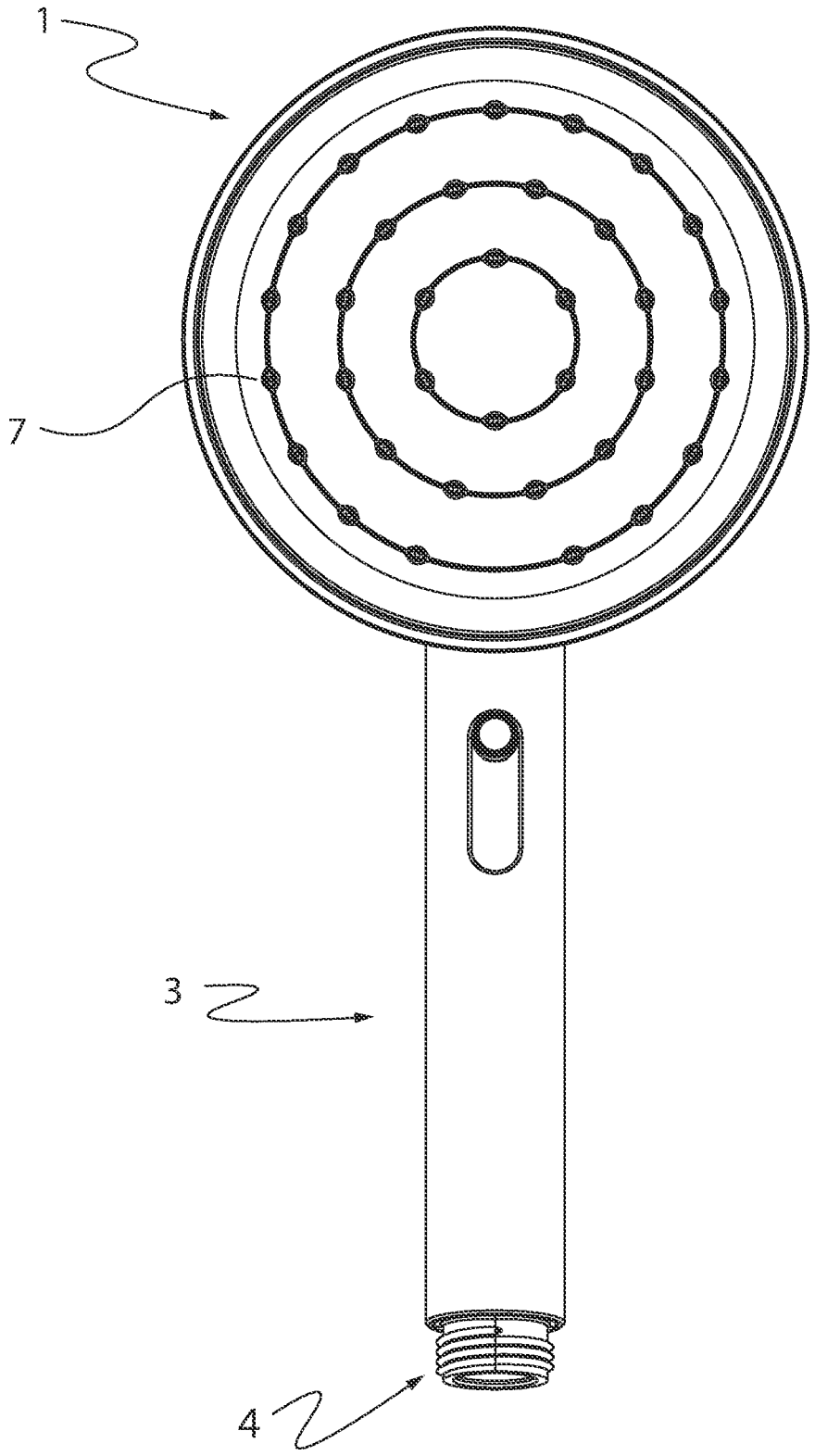
FIG. 24 Shows a front view of the embodiment of FIG. 21.
Figure 25:
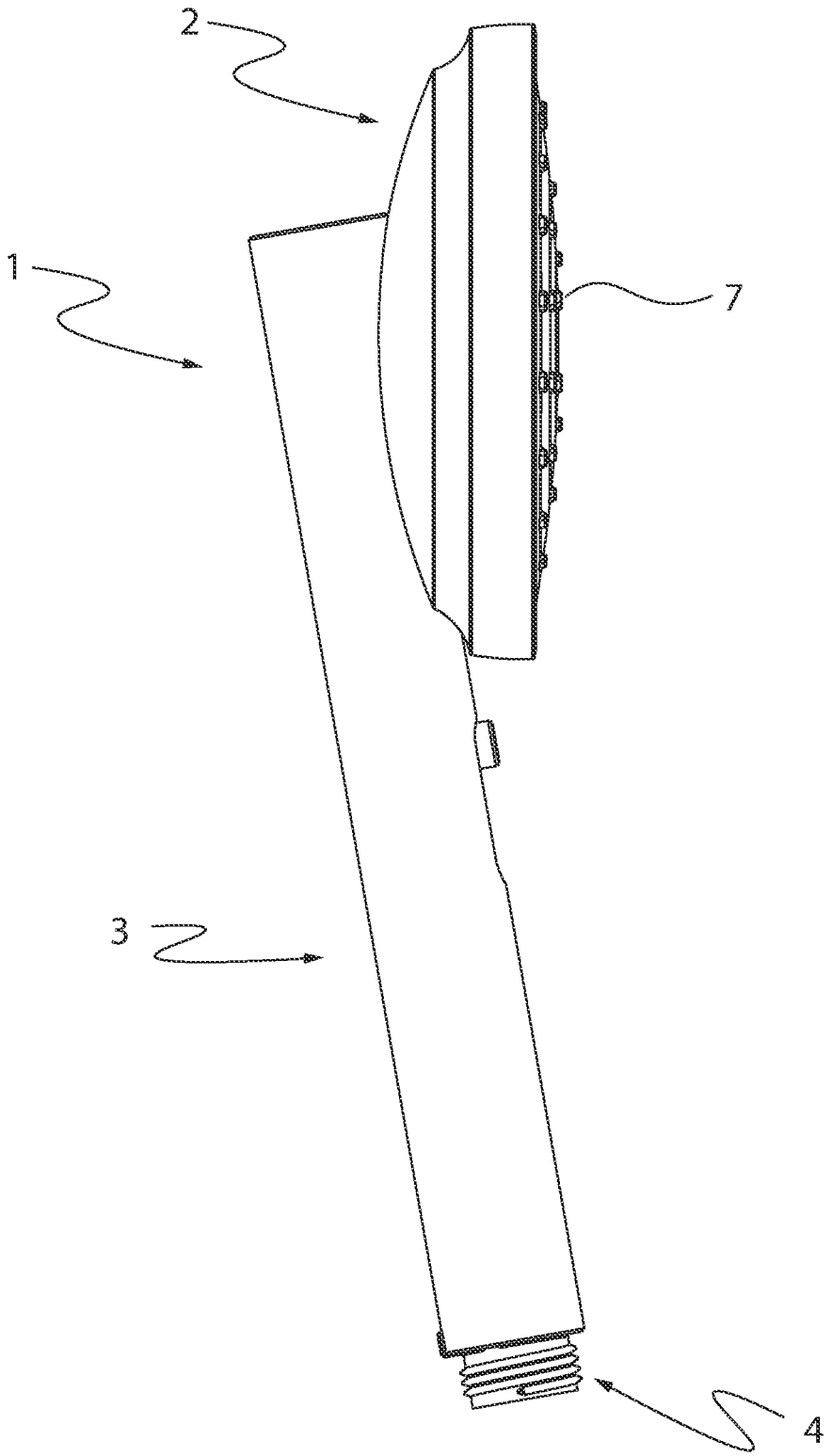
FIG. 25 Shows a left hand side view of the embodiment of FIG. 21.
Figure 26:
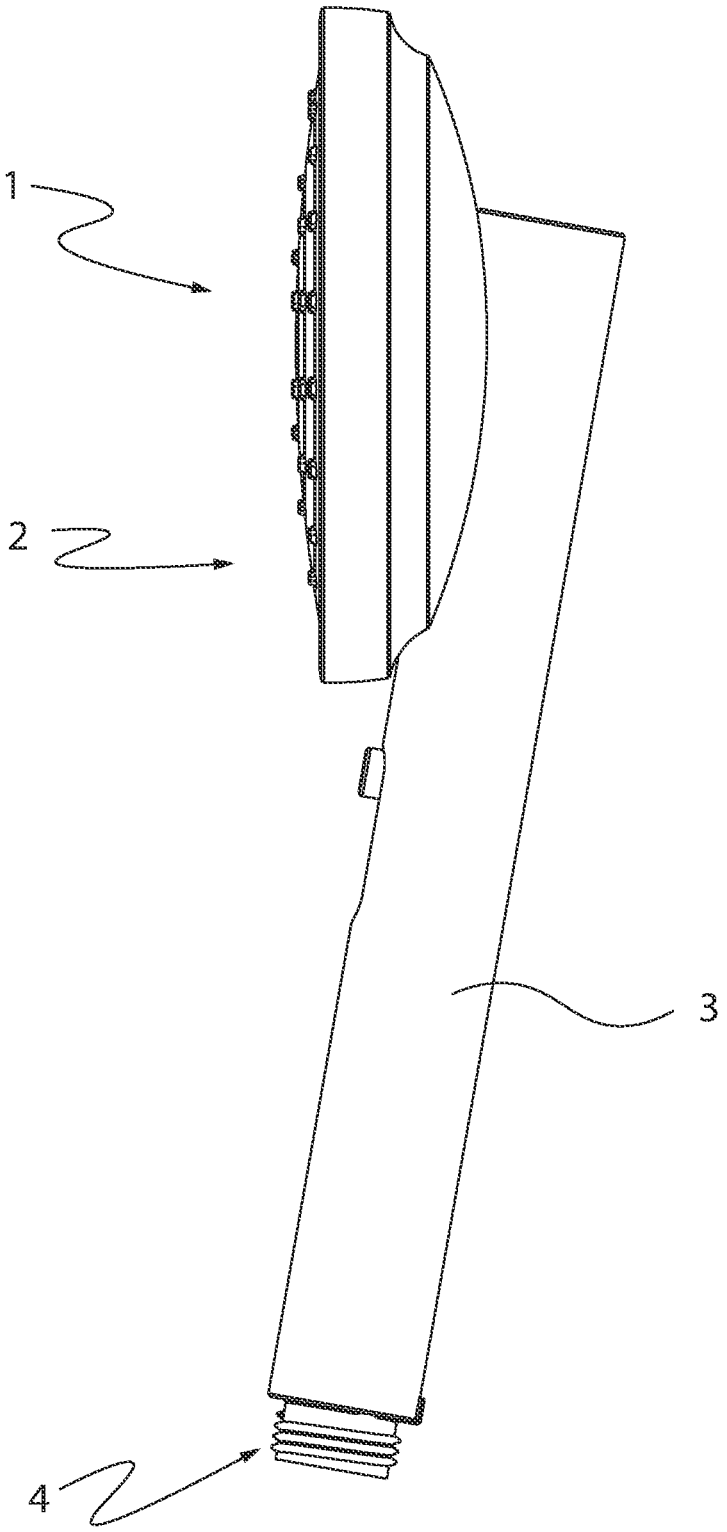
FIG. 26 Shows a right hand side view of the embodiment of FIG. 21.
Figure 27:
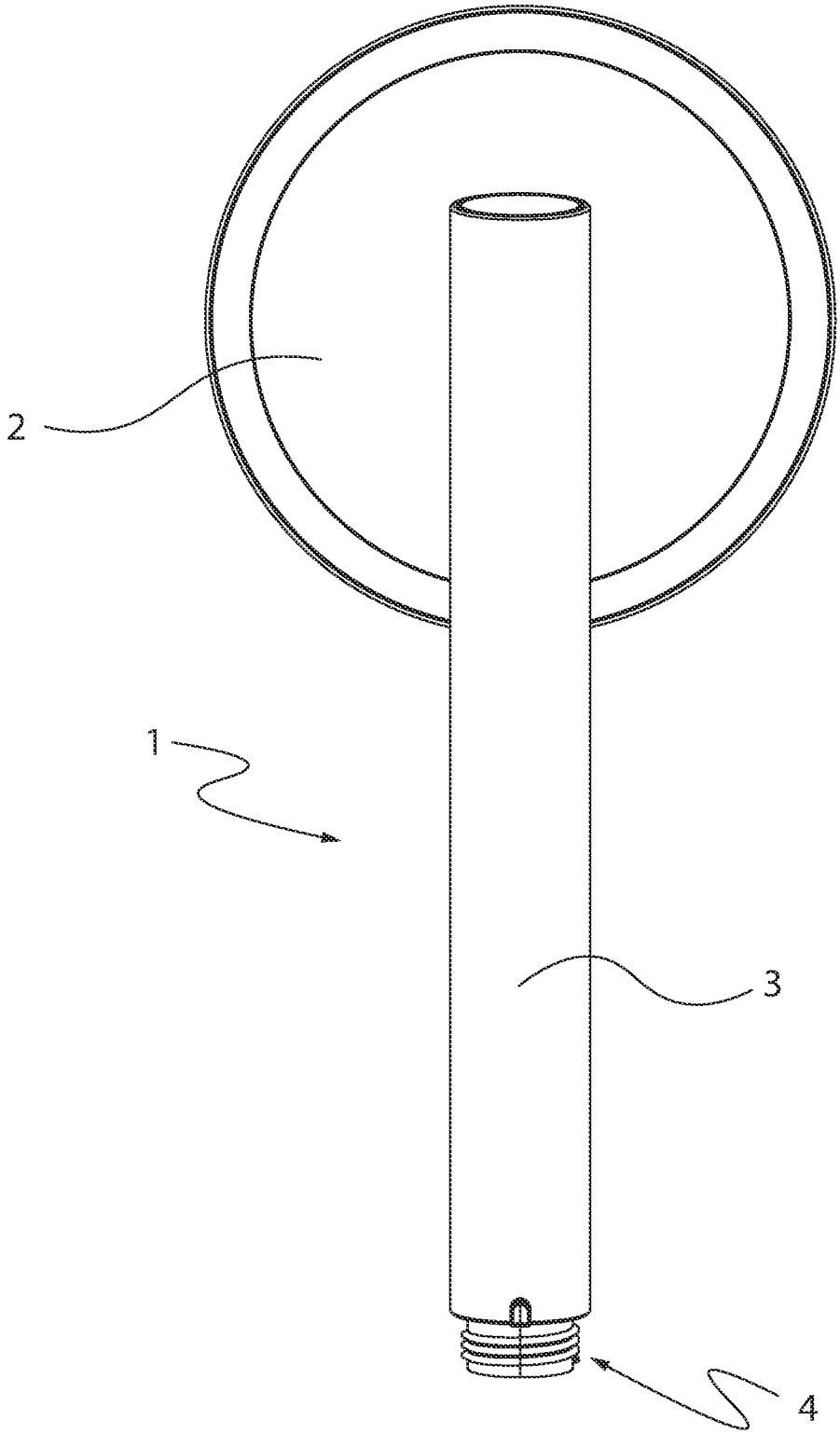
FIG. 27 Shows a rear view of the embodiment of FIG. 21.

The cover plate 22 is shown in front view and rear view in FIGS. 19 and 16 respectively. The cover plate fastens the components together using the fasteners 43 to form the cassette. It also is made from a substantially rigid resilient material such as a plastics material or similar. The cover plate 22 forms the second fluid volume between its front surface and the rear of the top plate 20. The second fluid volume is fed by the second fluid supply 24 as shown at least in FIG. 19. The cover plate 22 also allows for through pass of the first fluid supply 23 via the first fluid supply pathway, on its way to the first fluid volume. Thus the cover plate forms a sealed conduit from the head 2, through the second fluid volume 26. The cover plate seals at its front periphery to the back periphery of the top plate 20.

A further, or second variation of the spray head 1 for use in a shower or similar is shown in FIGS. 21 through 27, either as a hand held spray head, or mounted to a rail or similar in known ways. In this embodiment there is no separate connection ring 30 to act as a trim. Instead the head 2 has no complimentary recesses 39 apparent on its external periphery and receives and holds the faceplate 21 and resulting cassette as earlier described. This embodiment reduces the component count, but functions in an identical way.

While the spray head 1 has been discussed here as connected to a shower flex and may be connected to a shower rail in know ways, it may also be mounted in other ways. For example rather than by a flexible hose, it could be directly plumbed to a supply of fluid, whether in front or behind a wall or ceiling, and could be rigidly connected, or could be on an angularly adjustable mount.

Also the sliding valve, or its actuation, may be distanced from the spray head 1. For example, if the spray head 1 is mounted overhead for example from a ceiling, then the sliding valve, or control therefor, could be mounted on a wall, fluid supply rail, or similar at a level reachable by the user.

The foregoing description of the invention includes preferred forms thereof. Modifications may be made thereto without departing from the scope of the invention.

The invention claimed is:

1. A spray head adapted for connection to a supply of fluid, comprising:

a body to receive the supply of fluid, a plurality of conical mixing volumes, in fluid connection with the body and supply of fluid, each conical mixing volume having an outlet, each conical mixing volume including:

a. at least one first inlet for a flow of fluid into the conical mixing volume at an angle to a conical axis thereof, and b. a plurality of second inlets for a flow of fluid into the conical mixing volume substantially parallel to the conical axis, and a valve disposed upstream of the conical mixing volumes, the valve adapted to divide and vary the supply of fluid flow between the at least one first inlet and the at least one second inlet, which in turn varies the output of the fluid from the outlet of the conical mixing volumes.

2. The spray head of claim 1 wherein the valve is a sliding valve to divide and vary the supply of fluid.

3. The spray head of claim 1 wherein the at least one first inlet and at least one second inlet of the plurality of second inlets are formed by an open top at a base of the conical mixing volume.

4. The spray head of claim 1 wherein at least one second inlet of the plurality of second inlets is upstream of the at least one first inlet.

5. The spray head of claim 1 wherein the outlet is formed by an aperture at a peak of the conical mixing volume.

6. The spray head of claim 1 wherein the output of the fluid from the outlet can be varied from, and anywhere in between as a continuum, a fine mist to a hard stream, or needles of water.

7. The spray head of claim 1 wherein at least one second inlet of the plurality of second inlets is formed as an inlet aperture.

8. The spray head of claim 1 wherein the at least one first inlet comprises a plurality of inlets.

9. The spray head of claim 1 wherein the plurality of conical mixing volumes is part of a first unitary body, as a conical volume plate.

10. The spray head of claim 1 wherein each of the conical mixing volumes at least in part defines the at least one first inlet.

11. The spray head of claim 1 wherein the at least one first inlet is at substantially ninety degrees to the conical axis.

12. The spray head of claim 9 wherein at least one second inlet of the plurality of second inlets is in a second unitary body, as a top plate and wherein the top plate seals to the conical volume plate.

13. The spray head of claim 9 wherein there is a face plate located downstream and sealed to the conical volume plate.

14. The spray head of claim 13 wherein the face plate has apertures there through for the outlets.

15. The spray head of claim 2 wherein the sliding valve includes a valve body which slides along a major axis of the body.

16. The spray head of claim 1 wherein the at least first one inlet is at a tangent to the conical axis.

17. The spray head of claim 1 wherein the valve is a rotary valve to divide and vary the supply of fluid.

18. The spray head of claim 1 wherein each conical mixing volume includes four second inlets of the plurality of second inlets each of said four second inlets formed as an inlet aperture.

19. The spray head of claim 1 wherein the at least one second inlet of the plurality of second inlets is offset from the conical axis.

20. The spray head of claim 1 wherein the interior of the conical mixing volume tapers from a base of the conical mixing volume to the outlet formed by an aperture at a peak of the conical mixing volume.

21. A spray head adapted for connection to a supply of fluid, comprising:

a body to receive the supply of fluid, a plurality of conical mixing volumes, in fluid connection with the body and supply of fluid, each conical mixing volume having an outlet, each conical mixing volume including:

a. at least one first inlet for a flow of fluid into the conical mixing volume at an angle to a conical axis thereof, and b. at least one second inlet for a flow of fluid into the conical mixing volume substantially parallel to the conical axis and offset from the conical axis, and a valve disposed upstream of the conical mixing volumes, the valve adapted to divide and vary the supply of fluid flow between the at least one first inlet and the at least one second inlet, which in turn varies the output of the fluid from the outlet of the conical mixing volumes, wherein the conical axis intersects the outlet.

22. A spray head adapted for connection to a supply of fluid, comprising:

a body to receive the supply of fluid, a plurality of conical mixing volumes, in fluid connection with the body and supply of fluid, each conical mixing volume having an outlet, each conical mixing volume tapering from a base to the outlet formed by an aperture at a peak of the conical mixing volume and including:

a. at least one first inlet for a flow of fluid into the conical mixing volume at an angle to a conical axis thereof, and b. at least one second inlet disposed at or toward the base for a flow of fluid into the conical mixing volume substantially parallel to the conical axis, and a valve disposed upstream of the conical mixing volumes, the valve adapted to divide and vary the supply of fluid flow between the at least one first inlet and the at least one second inlet, which in turn varies the output of the fluid from the outlet of the conical mixing volumes.

* * * * *